US011077659B2

(12) United States Patent
Kashimura et al.

(10) Patent No.: US 11,077,659 B2
(45) Date of Patent: Aug. 3, 2021

(54) LIQUID EJECTING APPARATUS AND DRIVING CIRCUIT

(71) Applicant: Seiko Epson Corporation, Tokyo (JP)

(72) Inventors: Tom Kashimura, Shiojiri (JP); Yuki Watanabe, Shiojiri (JP)

(73) Assignee: Seiko Epson Corporation

( * ) Notice: Subject to any disclaimer, the term of this patent is extended or adjusted under 35 U.S.C. 154(b) by 49 days.

(21) Appl. No.: 16/581,831

(22) Filed: Sep. 25, 2019

(65) Prior Publication Data

US 2020/0101738 A1 Apr. 2, 2020

(30) Foreign Application Priority Data

Sep. 27, 2018 (JP) ..... JP2018-181771

(51) Int. Cl.
*B41J 2/14* (2006.01)
*B41J 2/045* (2006.01)

(52) U.S. Cl.
CPC ..... *B41J 2/14209* (2013.01); *B41J 2/04541* (2013.01); *B41J 2/04581* (2013.01); *B41J 2/04588* (2013.01); *B41J 2002/14491* (2013.01)

(58) Field of Classification Search
CPC ..... B41J 2/14209; B41J 2/04501; B41J 2/04541; B41J 2002/14491; B41J 2/04581; B41J 2/04588; B41J 2/04593
See application file for complete search history.

(56) References Cited

U.S. PATENT DOCUMENTS

2004/0066425 A1* 4/2004 Togashi ..... B41J 2/04581 347/9
2015/0246531 A1* 9/2015 Abe ..... B41J 2/04593 347/9
2018/0178510 A1 6/2018 Nakajima

FOREIGN PATENT DOCUMENTS

JP 2018-099865 A 6/2018

* cited by examiner

*Primary Examiner* — Henok D Legesse

(74) *Attorney, Agent, or Firm* — Harness, Dickey & Pierce, P.L.C.

(57) ABSTRACT

A liquid ejecting apparatus includes a liquid discharging head having a first nozzle and a first piezoelectric element, a first driving signal generating circuit, a substrate on which the first driving signal generating circuit is provided, a first wire, and a first coil, in which the first driving signal generating circuit generates a first driving signal, the first piezoelectric element is driven based on the first driving signal to discharge liquid from the first nozzle, and the first wire is electrically coupled to the first driving signal generating circuit and propagates the first driving signal to the first piezoelectric element through the first coil.

8 Claims, 17 Drawing Sheets

| [SIH, SIL] | | [1, 1] LARGE DOT | [1, 0] MIDDLE DOT | [0, 1] SMALL DOT | [0, 0] NON-RECODING |
|---|---|---|---|---|---|
| S1 | T1 | H | H | H | L |
| | T2 | H | L | L | L |
| S2 | T1 | L | L | L | H |
| | T2 | L | H | L | L |

LIQUID EJECTING APPARATUS AND DRIVING CIRCUIT

The present application is based on, and claims priority from, JP Application Serial Number 2018-181771, filed Sep. 27, 2018, the disclosure of which is hereby incorporated by reference herein in its entirety.

BACKGROUND

1. Technical Field

The present disclosure relates to a liquid ejecting apparatus and a driving circuit.

2. Related Art

It has been known that a piezoelectric element such as a piezo element is used in an ink jet printer (a liquid ejecting apparatus) that prints an image or a document by discharging a liquid such as ink. The piezoelectric element is provided in a print head (a liquid ejecting head) to correspond to a plurality of nozzles for discharging ink and a cavity for storing the ink discharged from the nozzles. Then, as the piezoelectric element is displaced according to a driving signal, a diaphragm provided between the piezoelectric element and the cavity is displaced. Accordingly, the internal volume of the cavity is changed, and the ink stored inside the cavity is discharged from the nozzle. In such a liquid ejecting apparatus, the driving signal supplied to the piezoelectric element is generated by a driving circuit and is supplied to a print head through a wiring pattern formed on a substrate on which a driving signal generating circuit is provided and a cable electrically coupled to the substrate.

A liquid ejecting apparatus 1, which has a driving circuit for generating a driving signal and a print head for discharging ink and in which as both the driving circuit and the print head are mounted on a carriage, inductance components of a wiring pattern and a cable through which the driving signal is propagated are reduced, is disclosed in JP-A-2018-99865.

However, in the liquid ejecting apparatus 1 disclosed in JP-A-2018-99865, since inductance components of a wiring pattern and a cable through which a driving signal is propagated are reduced, resistance components of the wiring pattern and the cable through which the driving signal is propagated are dominated, and thus a discharge speed of the ink discharged from a nozzle may be reduced.

SUMMARY

According to an aspect of the present disclosure, there is provided a liquid ejecting apparatus including a liquid discharging head having a first nozzle and a first piezoelectric element, a first driving signal generating circuit, a substrate on which the first driving signal generating circuit is provided, a first wire, and a first coil, in which the first driving signal generating circuit generates a first driving signal, the first piezoelectric element is driven based on the first driving signal to discharge liquid from the first nozzle, and the first wire is electrically coupled to the first driving signal generating circuit and propagates the first driving signal to the first piezoelectric element through the first coil.

The liquid ejecting apparatus may include a resistance element, in which the first wire may propagate the first driving signal to the first piezoelectric element through the first coil and the resistance element.

In the liquid ejecting apparatus, the first coil may be provided on the substrate.

The liquid ejecting apparatus may further include a second driving signal generating circuit that may generate a second driving signal, a second wire, and a second coil, in which the liquid discharging head may have a second nozzle and a second piezoelectric element, the second piezoelectric element may be driven based on the second driving signal to discharge liquid from the second nozzle, and the second wire may be electrically coupled to the second driving signal generating circuit and may propagate the second driving signal to the second piezoelectric element through the second coil.

In the liquid ejecting apparatus, a waveform of the first driving signal may be different from a waveform of the second driving signal, and an inductance value of the first coil may be different from an inductance value of the second coil.

The liquid ejecting apparatus may further include an output connector to which the first wire and the second wire may be electrically coupled, in which the second driving signal generating circuit and the output connector may be provided on the substrate, a shortest distance between the first driving signal generating circuit and the output connector may be smaller than a shortest distance between the second driving signal generating circuit and the output connector, and an inductance value of the first coil may be larger than an inductance value of the second coil.

The liquid ejecting apparatus may further include a head unit including the substrate on which the first driving signal generating circuit may be provided and the liquid discharging head and a discharge control circuit that may generate a signal for controlling an operation of the head unit, in which the head unit and the discharge control circuit may be electrically coupled to each other through a cable.

According to another aspect of the present disclosure, there is provided a driving circuit for driving a capacitive load, including a first driving signal generating circuit, a substrate on which the first driving signal generating circuit is provided, a first wire, and a first coil, in which the first driving signal generating circuit generates a first driving signal, and the first wire is electrically coupled to the first driving signal generating circuit and propagates the first driving signal to the capacitive load through the first coil.

DESCRIPTION OF EXEMPLARY EMBODIMENTS

Hereinafter, exemplary embodiments of the present disclosure will be described with reference to the accompanying drawings. The used drawings are for convenience of description. The embodiments described below do not wrongfully limit the scope of the present disclosure as set forth in the claims. Further, not all of configurations described below are necessarily essential configuration requirements of the present disclosure.

1. Outline of Liquid Ejecting Apparatus

A configuration of a liquid ejecting apparatus 1 according to the present embodiment will be described with reference to FIGS. 1 to 4.

Figure 1:
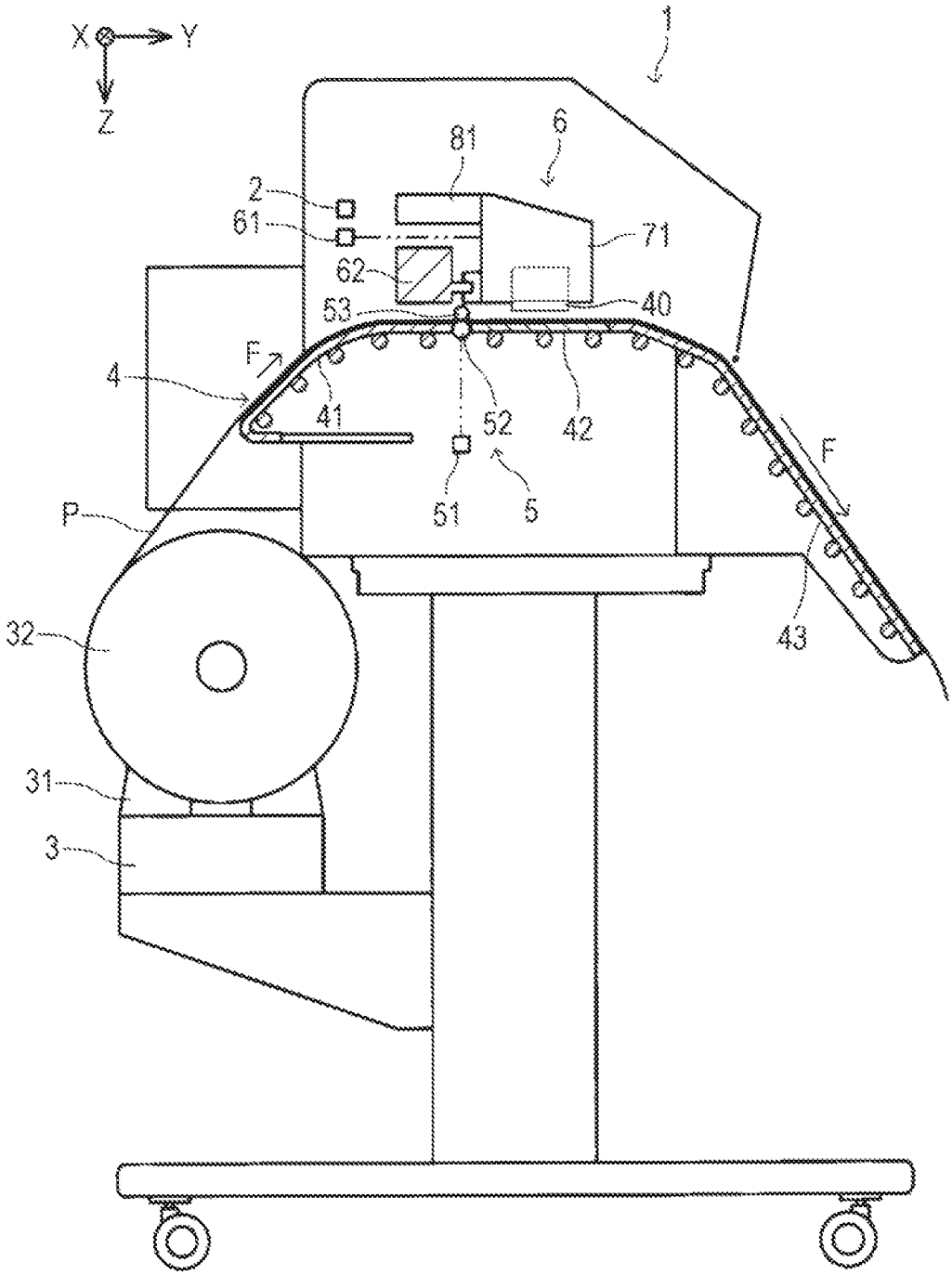
FIG. 1 is a side view showing a configuration of a liquid ejecting apparatus.
Figure 2:
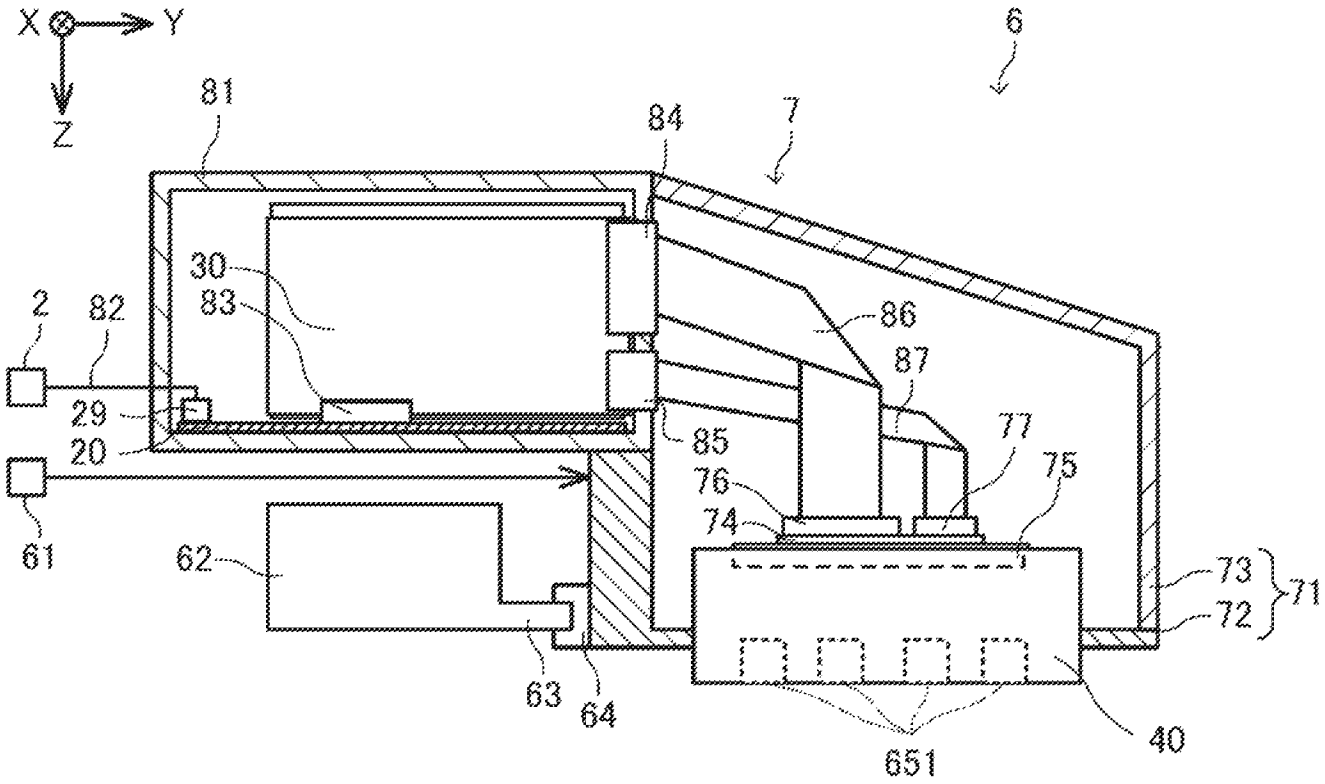
FIG. 2 is a side view showing a peripheral configuration of a printing unit of the liquid ejecting apparatus.
Figure 3:
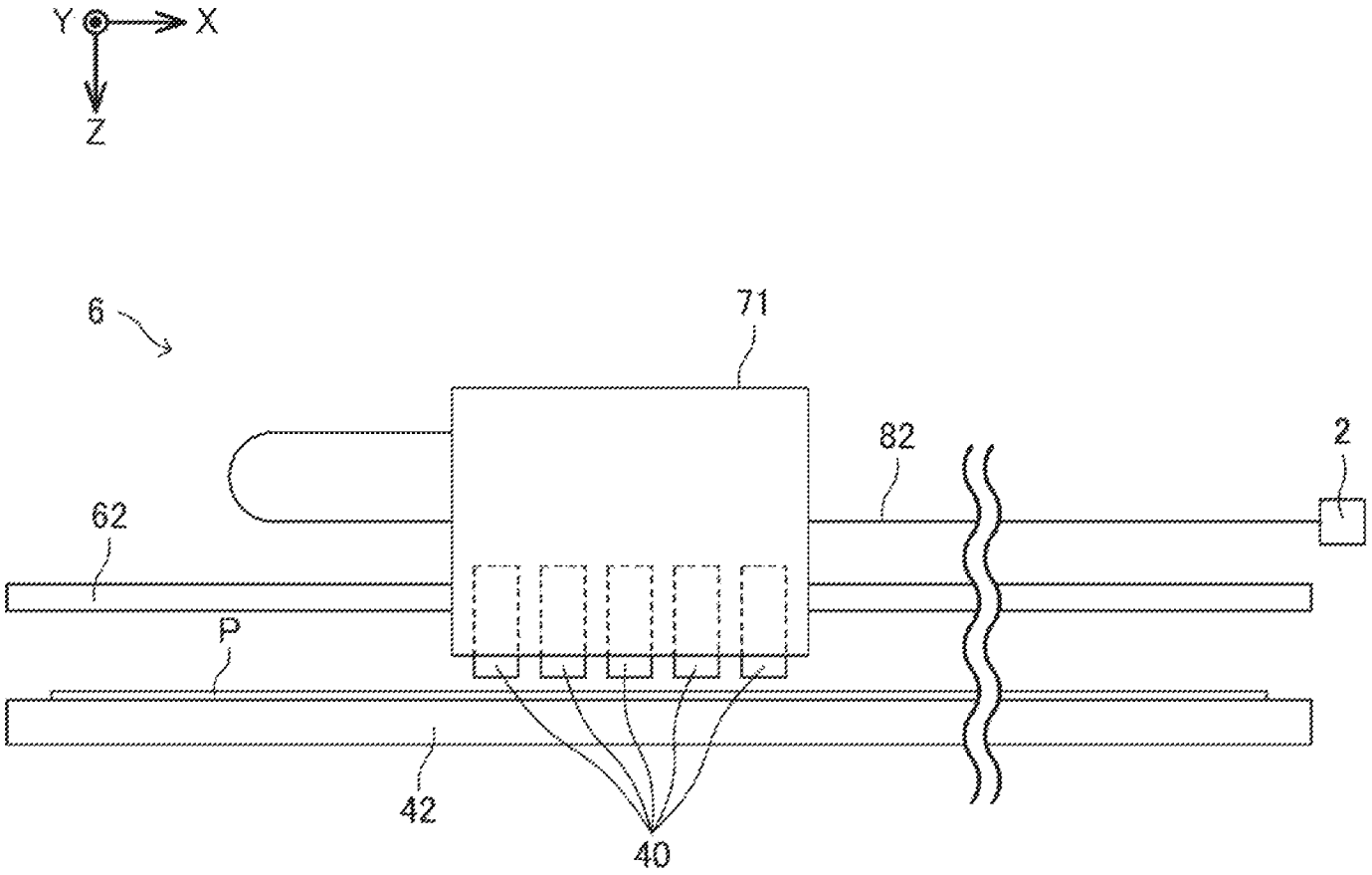
FIG. 3 is a front view showing the peripheral configuration of the printing unit of the liquid ejecting apparatus.
Figure 4:
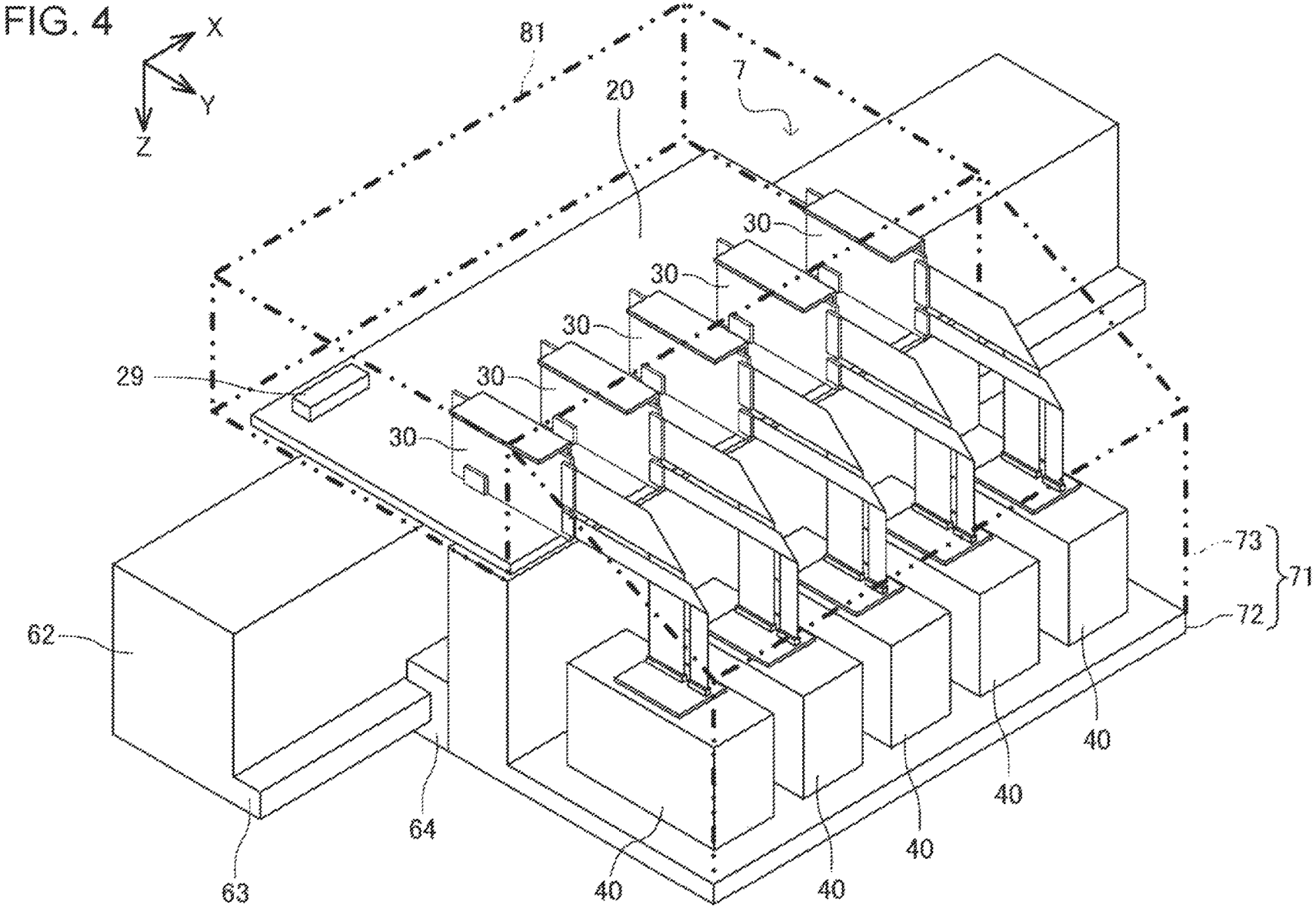
FIG. 4 is a perspective view showing the peripheral configuration of the printing unit of the liquid ejecting apparatus.

FIG. 1 is a side view showing a configuration of a liquid ejecting apparatus 1. FIG. 2 is a side view showing a peripheral configuration of a printing unit 6 of the liquid ejecting apparatus 1. FIG. 3 is a front view showing the peripheral configuration of the printing unit 6 of the liquid ejecting apparatus 1. FIG. 4 is a perspective view showing the peripheral configuration of the printing unit 6 of the liquid ejecting apparatus 1.

As shown in FIG. 1, the liquid ejecting apparatus 1 includes a delivery portion 3 that delivers a medium P, a support portion 4 that supports the medium P, a transport portion 5 that transports the medium P, a printing unit 6 that performs printing on the medium P, and a control unit 2 that controls these configurations.

In the following description, the width direction of the liquid ejecting apparatus 1 is referred to as an X direction, the depth direction of the liquid ejecting apparatus 1 is referred to as a Y direction, and the height direction of the liquid ejecting apparatus 1 is referred to as a Z direction. Further, a direction in which the medium P is transported is referred to as a transport direction F. The X direction, the Y direction, and the Z direction are perpendicular to each other. Further, the transport direction F intersects the X direction.

The control unit 2 is fixed to an inside of the liquid ejecting apparatus 1 to generate various signals for controlling the liquid ejecting apparatus 1 and to output the generated signals to corresponding various configurations.

The delivery portion 3 includes a holding member 31 that rotatably holds a roll body 32 on which the medium P is wound and stacked. The holding member 31 holds different kinds of media P and roll bodies 32 having different dimensions in the X direction. Then, in the delivery portion 3, as the roll body 32 is rotated in one direction, the medium P unwound from the roll body 32 is delivered to the support portion 4.

The support portion 4 includes a first support portion 41, a second support portion 42, and a third support portion 43, which constitute a transport path of the medium P from an upstream side to a downstream side in the transport direction F. The first support portion 41 guides the medium P delivered from the delivery portion 3 toward the second support portion 42, the second support portion 42 supports the medium P on which printing is performed, and the third support portion 43 guides the printed medium P toward a downstream side in the transport direction F.

The transport portion 5 includes a transport roller 52 that applies a transport force to the medium P, a driven roller 53 that presses the medium P against the transport roller 52, and a rotary mechanism that drives the transport roller 51.

The transport roller 52 is disposed beneath the transport path of the medium P in the Z direction, and the driven roller 53 is disposed on the transport path of the medium P in the Z direction. The rotary mechanism 51 is configured with, for example, a motor and a reduction gear. Then, in the transport portion 5, as the transport roller 52 rotates in a state in which the medium P is nipped by the transport roller 52 and the driven roller 53, the medium P is transported in the transport direction F.

As shown in FIGS. 2 and 3, the printing unit 6 includes a guide member 62 extending along the X direction, a carriage 71 supported by the guide member 62 to be movable along the X direction, a plurality of liquid discharging heads 40 mounted on the carriage 71 to discharge ink (liquid) to the medium P, and a movement mechanism 61 that moves the carriage 71 in the X direction. In the present embodiment, it is described that the carriage 71 is provided with five liquid discharging heads 40. Further, the printing unit 6 includes a heat dissipating case 81. A relay board 20 and a driving circuit board 30 are accommodated in the heat dissipating case 81.

The carriage 71 includes a carriage body 72 having a substantially L-shaped cross section when viewed from the X direction and a carriage cover 73 detachably attached to the carriage body 72 to form a closed space together with the carriage body 72. The five liquid discharging heads 40 are supported below the carriage 71 in the X direction at regular intervals, and a lower end portion of each liquid discharging head 40 protrudes outward from a lower surface of the carriage 71. A plurality of nozzles 651 that discharge the ink are formed on the lower surface of each liquid discharging head 40.

The movement mechanism 61 includes a motor and a reduction gear. Then, the movement mechanism 61 converts a rotational force of the motor into a moving force in the X direction of the carriage 71. Then, as the movement mechanism 61 is driven, the carriage 71 reciprocates in the X direction X while supporting the plurality of liquid discharging heads 40, a plurality of driving circuit boards 30, and the relay board 20.

As shown in FIGS. 2 and 4, a front end portion of the rectangular parallelepiped heat dissipating case 81 in which each driving circuit board 30 and the relay board 20 are accommodated is fixed to an upper end portion of a rear portion of the carriage 71.

The relay board 20 is mounted on the carriage 71 through the heat dissipating case 81. The relay board 20 is provided with a connector 29.

The connector 29 is connected to the control unit 2 through a cable 82. That is, the cable 82 electrically connects the relay board 20 mounted on the carriage 71 reciprocating in the X direction and the control unit 2 fixed to the liquid ejecting apparatus 1 to each other. Therefore, it is preferable that the cable 82 follows the reciprocation of the carriage 71 and is configured with a deformable flexible flat cable (FFC) or the like. Further, the plurality of driving circuit boards 30 stands above the relay board 20 in the Z direction and are arranged in parallel to each other in the X direction. The relay board 20 and the driving circuit board 30 are connected to each other through a connector 83 that is a board to board (B-to-B) connector.

The plurality of driving circuit boards 30 are mounted on the carriage 71 through the heat dissipating case 81. In detail, the plurality of driving circuit boards 30 are mounted on the heat dissipating case 81 while being arranged in the X direction at regular intervals. Then, connectors 84 and 85 are provided at a front end portion of the driving circuit board 30. The connectors 84 and 85 are exposed from the front surface of the heat dissipating case 81.

One end of a cable 86 configured with an FFC or the like is detachably connected to the connector 84, and one end of a cable 87 configured with an FFC or the like is detachably connected to the connector 85.

A connection board 74 is connected to an upper surface of the liquid discharging head 40 through a connector 75 that is a B-to-B connector. Connectors 76 and 77 are provided on the connection board 74. The other end of the cable 86 is detachably connected to the connector 76, and the other end of the cable 87 is detachably connected to the connector 77. Accordingly, the driving circuit boards 30 are electrically coupled to the liquid discharging heads 40, respectively.

Here, various configurations mounted on the carriage 71 including the plurality of driving circuit boards 30 and the plurality of liquid discharging heads 40 are examples of a head unit 7 according to the present embodiment.

As shown in FIGS. 2 and 4, the guide member 62 has a guide rail portion 63 extending from a lower portion of a front surface of the guide member 62 in the X direction. Further, the carriage 71 has a carriage support portion 64 at a lower end of a rear surface of the carriage 71. As the carriage support portion 64 is movably supported on the guide rail portion 63, the carriage 71 is slidably connected to the guide member 62.

As described above, in the liquid ejecting apparatus 1 according to the present embodiment, a control signal generated by the control unit 2 fixed to the liquid ejecting apparatus 1 is transmitted to the cable 82, and is input to the various configurations of the head unit 7 including the plurality of driving circuit boards 30 and the plurality of liquid discharging heads 40 mounted on the carriage 71. That is, the head unit 7 and the control unit 2 fixed to the liquid ejecting apparatus 1 are electrically coupled to each other through the cable 82.

2. Electrical Configuration of Liquid Ejecting Apparatus

Figure 5:
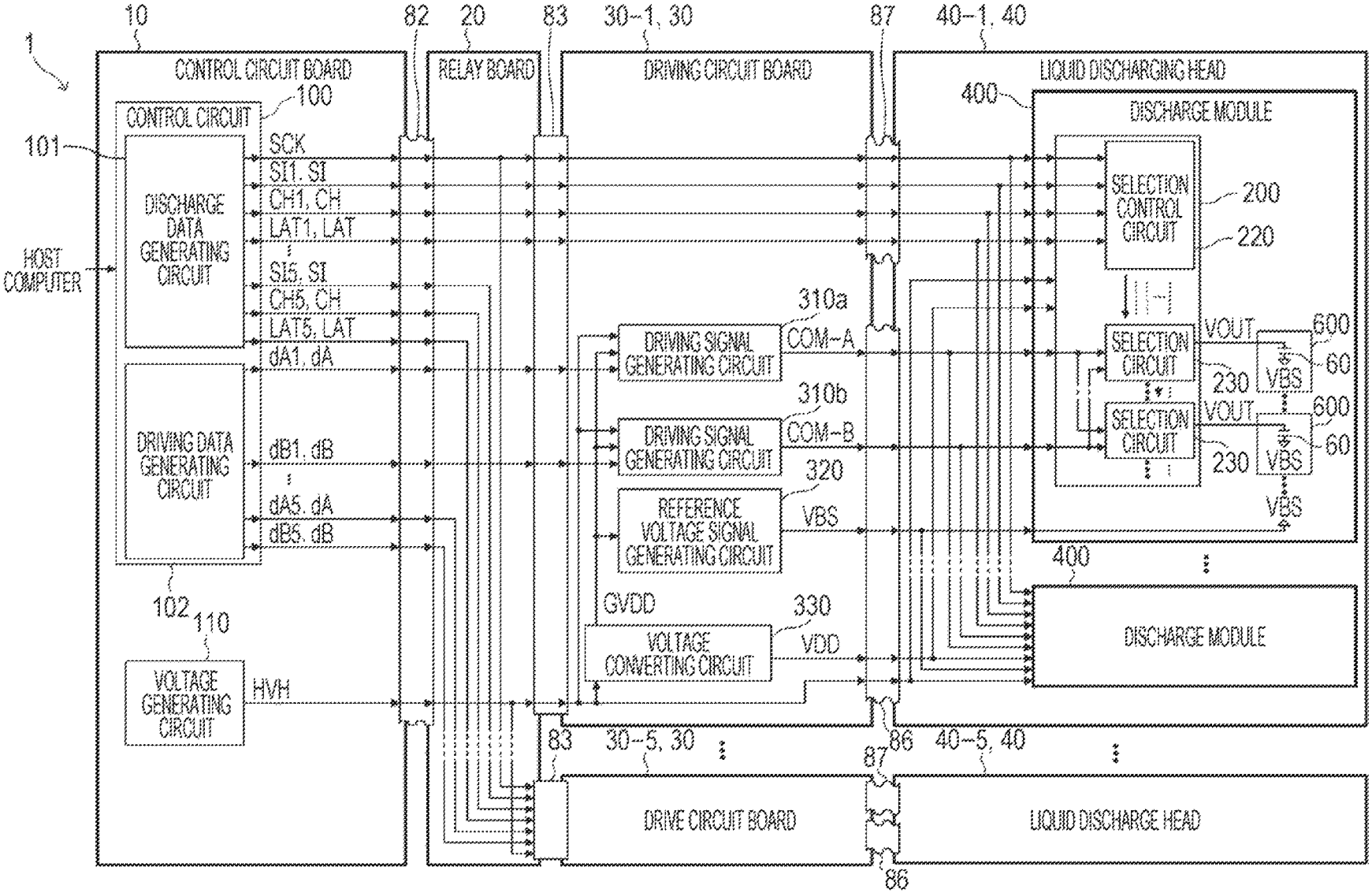
FIG. 5 is a block diagram showing an electrical configuration of the liquid ejecting apparatus.

Next, an electrical configuration of the liquid ejecting apparatus 1 will be described. FIG. 5 is a block diagram showing the electrical configuration of the liquid ejecting apparatus 1. As shown in FIG. 5, the liquid ejecting apparatus 1 includes a control circuit board 10, the relay board 20, the five driving circuit boards 30-1 to 30-5, and the five liquid discharging heads 40-1 to 40-5. Here, as described above, the relay board 20, the driving circuit boards 30-1 to 30-5, and the liquid discharging heads 40-1 to 40-5 are mounted on the carriage 71. When all the driving circuit boards 30-1 to 30-5 have the same configuration and need not to be distinguished from each other, the driving circuit boards 30-1 to 30-5 are referred to as the driving circuit board 30. Similarly, when all the liquid discharging heads 40-1 to 40-5 have the same configuration and need not to be distinguished from each other, the liquid discharging heads 40-1 to 40-5 are referred to as the liquid discharging head 40. Further, in the present embodiment, the driving circuit boards **30-*n* (n=1 to 5) and the liquid discharging heads 40-*n* are provided to correspond to each other. That is, driving signals COM-A and COM-B generated by the driving circuit board 30-*n* are supplied to the liquid discharging head 40-*n*. The number of the driving circuit boards 30 mounted on the carriage 71 and the number of the liquid discharging heads 40 mounted on the carriage 71** are not limited to five.

The control circuit board 10 has a control circuit 100 including the control unit 2 shown in FIGS. 1 to 4, and a voltage generating circuit 110. Then, the control circuit board 10 is electrically coupled to the relay board 20 through the cable 82.

The voltage generating circuit 110 generates a voltage HVH of, for example, DC 42 V used in the liquid discharging apparatus 1, and outputs the voltage HVH to the relay board 20 through the cable 82.

The control circuit 100 includes a discharge data generating circuit 101 and a driving data generating circuit 102. Then, when various signals such as image data supplied from a host computer are input to the control circuit board 10, the control circuit 100 generates various control signals for controlling the driving circuit boards 30 and the liquid discharging heads 40, and outputs the generated control signals to the relay board 20 through the cable 82.

In detail, some of signals input to the control circuit 100 are input to the discharge data generating circuit 101. Then, the discharge data generating circuit 101 generates plural types of signals that control discharge of the ink, based on the input signals. In detail, the discharge data generating circuit 101 generates printing data signals SI1 to SI5 that designate selection of waveforms of the driving signals COM-A and COM-B, latch signals LAT1 to LAT5 that designate a discharge timing of the ink, change signals CH1 to CH5 that designate timings of waveform switching of the driving signals COM-A and COM-B, and a clock signal SCK that designates timings of the printing data signals SI1 to SI5, which will be described below, and outputs the generated signals to the relay board 20 through the cable 82.

Further, some of the signals input to the control circuit 100 are input to the driving data generating circuit 102. The driving data generating circuit 102 generates base driving signals dA1 to dA5 and dB1 to dB5 of digital signals, which are bases of the driving signals COM-A and COM-B for driving a discharge portion 600, based on the input signals, and outputs the generated signals to the relay board 20 through the cable 82.

Here, the control circuit 100, which generates the printing data signals SI-1 to SI-5, the latch signals LAT1 to LAT5, the change signals CH1 to CH5, the clock signal SCK, and the base driving signals dA1 to dA5 and dB1 to dB5 for controlling an operation of the head unit 7 including the liquid discharging heads 40 and the driving circuit boards 30, is an example of a discharge control circuit.

The relay board 20 is electrically coupled to the driving circuit boards 30-1 to 30-5 through the connector 83. Various signals such as the printing data signals SI1 to SI5, the latch signals LAT1 to LAT5, the change signals CH1 to CH5, the clock signal SCK, the base driving signals dA1 to dA5 and dB1 to dB5, and the voltage HVH, which are supplied through the cable 82, are relayed to the relay board 20, and are output to the corresponding driving circuit boards 30-1 to 30-5, respectively.

In detail, the relay board 20 relays the clock signal SCK, the printing data signal SI1, the latch signal LAT1, the change signal CH1, the base driving signals dA1 and dB1, and the voltage HVH, and supplies the relayed signals to the driving circuit board 30-1. Similarly, the relay board 20 relays the clock signal SCK, the printing data signal SIi (i=1 to 5), the latch signal LATi, the change signal CHi, the base driving signals dAi and dBi, and the voltage HVH, and supplies the relayed signals to the driving circuit board 30-*i*.

In the following description, the printing data signal SIi, the latch signal LATi, the change signal CHi, and the base driving signals dAi and dBi supplied to the driving circuit board 30 and the liquid discharging head 40 are referred to as the printing data signal SI, the latch signal LAT, the change signal CH, and the base driving signals dA and dB, respectively.

Here, various signals propagated from the control circuit board 10 to the relay board 20 through the cable 82 may be serial type differential signals used in a low voltage differential signaling (LVDS) transfer method, a low voltage positive emitter coupled logic (LVPECL) transfer method, a current mode logic (CML) transfer method, and the like. At this time, the control circuit board 10 may be provided with a conversion circuit for converting various signals transferred to the relay board 20 into the corresponding differential signals. Further, the relay board 20 may be provided with a restoration circuit for restoring the corresponding input differential signals.

The driving circuit board 30 has driving signal generating circuits 310*a* and 310*b*, a reference voltage signal generating circuit 320, and a voltage converting circuit 330. Then, the driving circuit board 30 is electrically coupled to the liquid discharging head 40 through the cables 86 and 87.

The voltage HVH is input to the voltage converting circuit 330. Then, the voltage converting circuit 330 converts a voltage value of the voltage HVH, generates a voltage VDD such as DC 3.3 V used as a power supply voltage of various configurations provided in the liquid discharging head 40, and outputs the voltage VDD to the liquid discharging head 40 through the cable 86. Further, the voltage converting circuit 330 converts the voltage value of the voltage HVH, generates a voltage GVDD such as DC 7.5 V for driving the driving signal generating circuits 310*a* and 310*b*, and outputs the voltage GVDD to the driving signal generating circuits 310*a* and 310*b*. The voltage converting circuit 330 may generate a plurality of voltage signals other than those described above.

The base driving signal dA, the voltage HVH, and the voltage GVDD are input to the driving signal generating circuit 310*a*. Then, the driving signal generating circuit 310*a* generates the driving signal COM-A. In detail, the driving signal generating circuit 310*a* operates using the voltage GVDD as a power supply voltage, performs digital/analog signal conversion on the input base driving signal dA, and then generates the driving signal COM-A by performing class D amplification on the converted analog signal based on the voltage HVH. Then, the driving signal generating circuit 310*a* outputs the driving signal COM-A to the liquid discharging head 40 through the cable 86. Similarly, the base driving signal dB, the voltage HVH, and the voltage GVDD are input to the driving signal generating circuit 310*b*. Then, the driving signal generating circuit 310*b* generates the driving signal COM-B. In detail, the driving signal generating circuit 310*b* operates using the voltage GVDD as a power supply voltage, performs digital/analog signal conversion on the input base driving signal dB, and then generates the driving signal COM-A by performing class D amplification on the converted analog signal based on the voltage HVH. Then, the driving signal generating circuit 310*b* outputs the driving signal COM-B to the liquid discharging head 40 through the cable 86.

That is, the base driving signal dA is a digital signal that defines the waveform of the driving signal COM-A, and the base driving signal dB is a digital signal that defines the waveform of the driving signal COM-B. Then, the driving signal generating circuits 310*a* and 310*b* generate the driving signals COM-A and COM-B by amplifying the waveforms defined by the base driving signals dA and dB. Therefore, the base driving signals dA and dB may be signals that can define the respective waveforms of the driving signals COM-A and COM-B, and may be, for example, analog signals. Details of the driving signal generating circuits 310*a* and 310*b* will be described below.

The voltage GVDD is input to the reference voltage signal generating circuit 320. Then, the reference voltage signal generating circuit 320 converts the voltage value of the voltage GVDD to generate a reference voltage signal VBS such as DC 6 V. Then, the reference voltage signal generating circuit 320 outputs the reference voltage signal VBS to the liquid discharging head 40 through the cable 86.

Further, the driving circuit board 30 propagates the voltage HVH input from the voltage generating circuit 110, and outputs the voltage HVH to the liquid discharging head 40 through the cable 86. Further, the driving circuit board 30 propagates the printing data signal SI, the latch signal LAT, and the clock signal SCK input from the discharge data generating circuit 101, and outputs the propagated signals to the liquid discharging head 40 through the cable 87.

As described above, the driving circuit board 30 and the liquid discharging head 40 are electrically coupled to each other through the cables 86 and 87. Then, the cable propagates the driving signals COM-A and COM-B, the voltages VDD and HVH, and the reference voltage signal VBS from the driving circuit board 30 to the liquid discharging head 40, and the cable 87 propagates the printing data signal SI, the latch signal LAT, the change signal CH, and the clock signal SCK. That is, the liquid ejecting apparatus 1 has the cable 86 that propagates the driving signals COM-A and COM-B, the voltages VDD and HVH, and the reference voltage signal VBS, which are high voltage signals, and the cable 87 that propagates the printing data signal SI, the latch signal LAT, and the clock signal SCK, which are low voltage signals for controlling the discharge of the ink. Accordingly, it is possible to reduce a possibility that the high voltage signals and the low voltage signals interfere with each other.

The liquid discharging head 40 has a plurality of discharge modules 400. Further, each of the discharge modules 400 includes a driving signal selecting circuit 200 and a plurality of discharge portions 600.

The driving signal selecting circuit 200 includes a selection control circuit 220 and a plurality of selection circuits 230. The driving signal selecting circuit 200 is configured with, for example, an integrated circuit (IC), and is operated with the voltage VDD.

The selection control circuit 220 receives input of the printing data signal SI, the latch signal LAT, the change signal CH, and the clock signal SCK. Then, the selection control circuit 220 generates a signal for controlling which of the driving signals COM-A and COM-B should be selected or deselected, and outputs the signal to the plurality of selection circuits 230.

The driving signals COM-A and COM-B are input to each of the selection circuits 230. Then, as the input driving signals COM-A and COM-B are selected or deselected according to the signal output from the selection control circuit 220, the driving signal VOUT is generated, and is output to the corresponding discharge portion 600.

Further, the voltage HVH is also input to the driving signal selecting circuit 200. The signal for controlling which of the driving signals COM-A and COM-B supplied to the selection circuits 230 should be selected or deselected is level-shifted to a high amplitude logic signal based on the voltage HVH by a not-shown level shifter. The selection circuits 230 select the driving signals COM-A and COM-B amplified based on the voltage HVH. Therefore, the signal for controlling which of the driving signals COM-A and COM-B supplied to the selection circuits 230 should be selected or deselected is level-shifted to the high amplitude logic signal based on the voltage HVH, so that it is possible to more certainly execute selection of the driving signals COM-A and COM-B.

As described above, the driving signal selecting circuit 200 generates the driving signal VOUT by selecting or deselecting the input driving signals COM-A and COM-B, and supplies the generated driving signal VOUT to piezoelectric elements 60 that are examples of capacitive loads. In other words, the driving signal selecting circuit 200 controls supply of the driving signals COM-A and COM-B to the piezoelectric elements 60.

The discharge portions 600 include the piezoelectric elements 60, and are provided in the selection circuits 230, respectively. The driving signal VOUT output from the selection circuit 230 is supplied to one end of the piezoelectric element 60, and the reference voltage signal VBS is supplied to the other end of the piezoelectric element 60. Then, the piezoelectric element 60 is driven based on the driving signal VOUT and the reference voltage signal VBS, and discharges the ink from the discharge portion 600.

Here, the driving signal generating circuit 310*a* provided in the driving circuit board 30-1 is an example of a first driving signal generating circuit, and the driving signal COM-A generated by the driving signal generating circuit 310*a* is an example of a first driving signal. Further, the driving signal generating circuit 310*b* provided in the driving circuit board 30-1 is an example of a second driving signal generating circuit, and the driving signal COM-B generated by the driving signal generating circuit 310*b* is an example of a second driving signal. Then, among the plurality of piezoelectric elements 60 included in the liquid discharging head 40-1 corresponding to the driving circuit board 30-1, any one of the piezoelectric elements 60 driven by the supply of the driving signal COM-A is an example of a first piezoelectric element. The nozzle 651 corresponding to the corresponding piezoelectric element 60 is an example of a first nozzle. Further, among the plurality of piezoelectric elements 60 included in the liquid discharging head 40-1 corresponding to the driving circuit board 30-1, any one of the piezoelectric elements 60 driven by the supply of the driving signal COM-B is an example of a second piezoelectric element. The nozzle 651 corresponding to the corresponding piezoelectric element 60 is an example of a second nozzle.

Further, The driving signal generating circuit 310*a* provided in the driving circuit board 30-2 is another example of a second driving signal generating circuit, and the driving signal COM-A generated by the corresponding driving signal generating circuit 310*a* is another example of a second driving signal. Then, among the plurality of piezoelectric elements 60 included in the liquid discharging head 40-2 corresponding to the driving circuit board 30-2, any one of the piezoelectric elements 60 driven by the supply of the driving signal COM-A is another example of a second piezoelectric element. The nozzle 651 corresponding to the corresponding piezoelectric element 60 is another example of a second nozzle.

3. Configuration of Liquid Discharging Head

Figure 6:
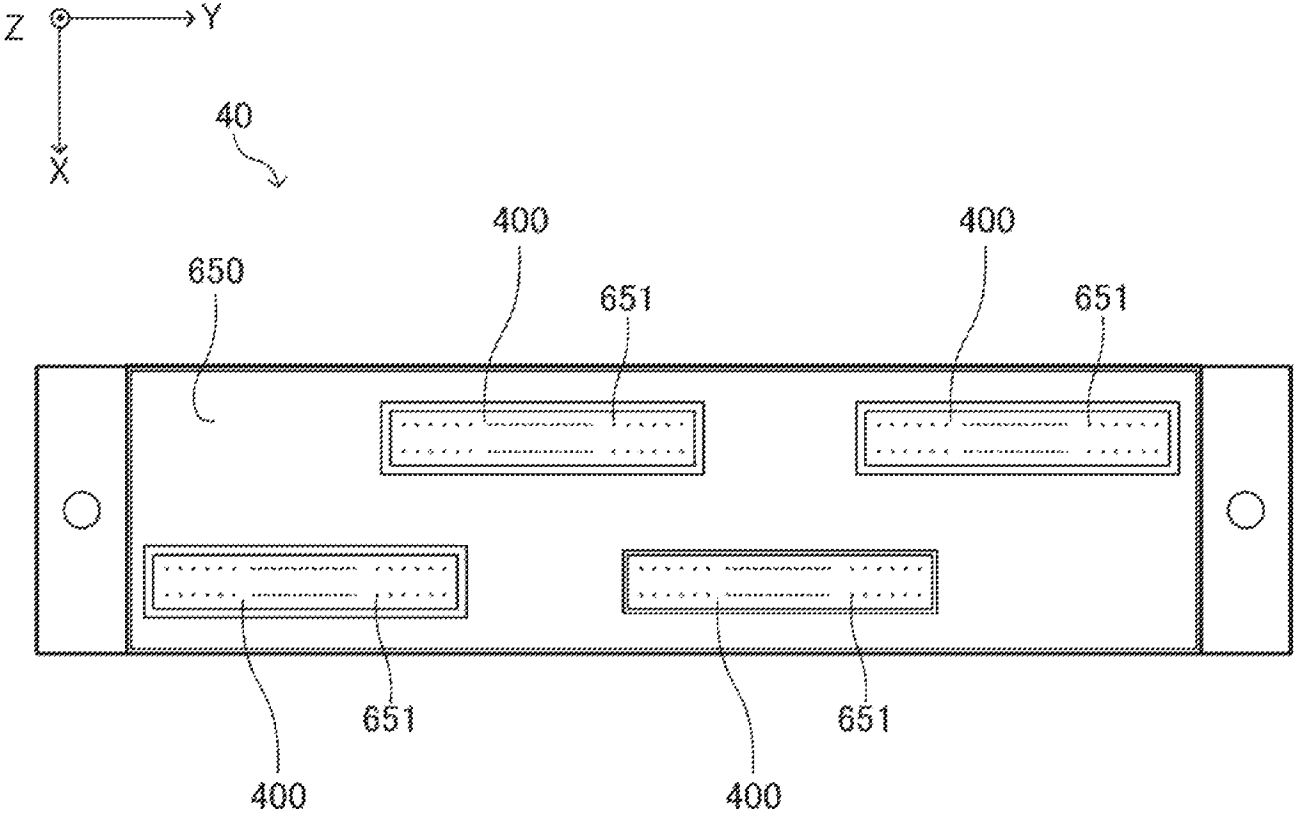
FIG. 6 is a diagram showing a configuration of an ink discharge surface.
Figure 7:
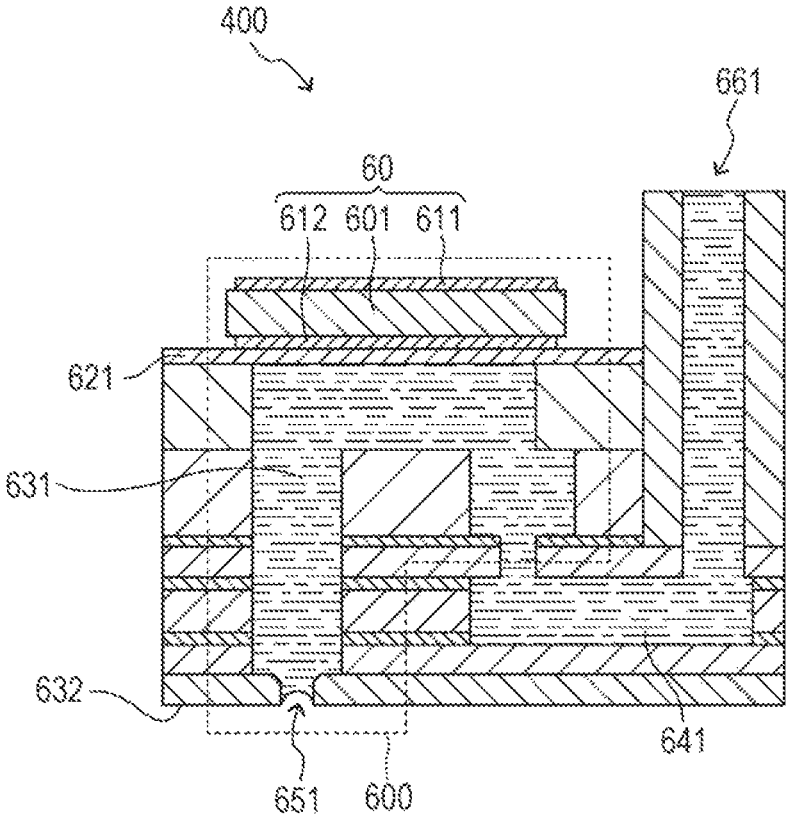
FIG. 7 is a diagram showing a schematic configuration of one of a plurality of discharge portions.

Next, a configuration of the liquid discharging head 40 will be described with reference to FIGS. 6 and 7. FIG. 6 is a diagram showing a configuration of an ink discharge surface 650 on which the plurality of nozzles 651 from which the ink is discharged are formed in the liquid discharging head 40. FIG. 7 is a diagram showing a schematic configuration of one of the plurality of discharge portions 600 included in the discharge modules 400. As shown in FIGS. 6 and 7, the liquid discharging head 40 has the nozzle 651 that discharges the ink and the piezoelectric element 60.

As shown in FIG. 6, in the liquid discharging head 40, four discharge modules 400 are arranged in a zigzag. In each of the discharge modules 400, the nozzles 651 provided in parallel in the Y direction are formed in two rows in the X direction. In the discharge module 400, 300 or more nozzles 651 are arranged per inch in parallel along the X direction. Further, 600 or more nozzles 651 are provided in one discharge module 400. That is, 2400 or more nozzles 651 are provided in the liquid discharging head 40 according to the present embodiment. Further, a not-shown ink channel communicating with the nozzle 651 is provided inside the discharge module 400.

Further, as shown in FIG. 7, the discharge module 400 includes the discharge portion 600 and a reservoir 641. The ink is introduced from an ink supply port 661 into the reservoir 641.

The discharge portion 600 includes the piezoelectric element 60, a diaphragm 621, a cavity 631, and the nozzle 651. The diaphragm 621 is deformed according to displacement of the piezoelectric element 60 provided on an upper surface in FIG. 7. Then, the diaphragm 621 functions as a diaphragm that enlarges/reduces the internal volume of the cavity 631. The ink is filled in the cavity 631. Then, the cavity 631 functions as a compression chamber, the internal volume of which changes according to the displacement of the piezoelectric element 60. The nozzle 651 is an opening portion formed in a nozzle plate 632 and communicating with the cavity 631. Then, the ink stored inside the cavity 631 is discharged from the nozzle 651 according to the change in the internal volume of the cavity 631.

The piezoelectric element 60 has a structure in which a piezoelectric body 601 is interposed between a pair of electrodes 611 and 612. In the piezoelectric body 601 having this structure, central portions of the electrodes 611 and 612 and the diaphragm 621 are bent in a vertical direction of FIG. 7 with respect to both end portions according to a potential difference between the electrode 611 and the electrode 612. In detail, the driving signal VOUT is supplied to the electrode 611 which is the one end of the piezoelectric element 60, and the reference voltage signal VBS is supplied to the electrode 612 which is the other end of the piezoelectric element 60. Then, the voltage of the driving signal VOUT decreases, a central portion of the piezoelectric element 60 is bent upward, and when the voltage of the driving signal VOUT increases, the central portion of the piezoelectric element 60 is bent downward. That is, when the piezoelectric element 60 is bent upward, the internal volume of the cavity 631 is enlarged. Thus, the ink is drawn from the reservoir 641. Further, when the piezoelectric element 60 is bent downward, the internal volume of the cavity 631 is reduced. Thus, the amount of the ink corresponding to a degree of the reduction of the internal volume of the cavity 631 is discharged from the nozzle 651. As described above, the piezoelectric element 60 is displaced due to a potential difference between the driving signal VOUT based on the driving signals COM-A and COM-B and the reference voltage signal VBS. In other words, the piezoelectric element 60 is driven by the potential difference between the driving signal VOUT supplied to the electrode 611 and based on the driving signals COM-A and COM-B and the reference voltage signal VBS supplied to the electrode 612. Then, the piezoelectric element 60 is displaced to cause the ink to be discharged from the nozzle 651. The piezoelectric element 60 is not limited to the shown structure, and may have any structure that can discharge the ink according to the displacement of the piezoelectric element 60. Further, the piezoelectric element 60 is not limited to bending vibration, and may be configured to use longitudinal vibration.

4. Example of Driving Signal and Operation of Driving Signal Selecting Circuit Here, examples of waveforms of the driving signals COM-A and COM-B generated by the driving signal generating circuits 310*a* and 310*b* and examples of waveforms of the driving signal VOUT supplied to the piezoelectric element 60 will be described using FIGS. 8 and 9.

Figure 8:
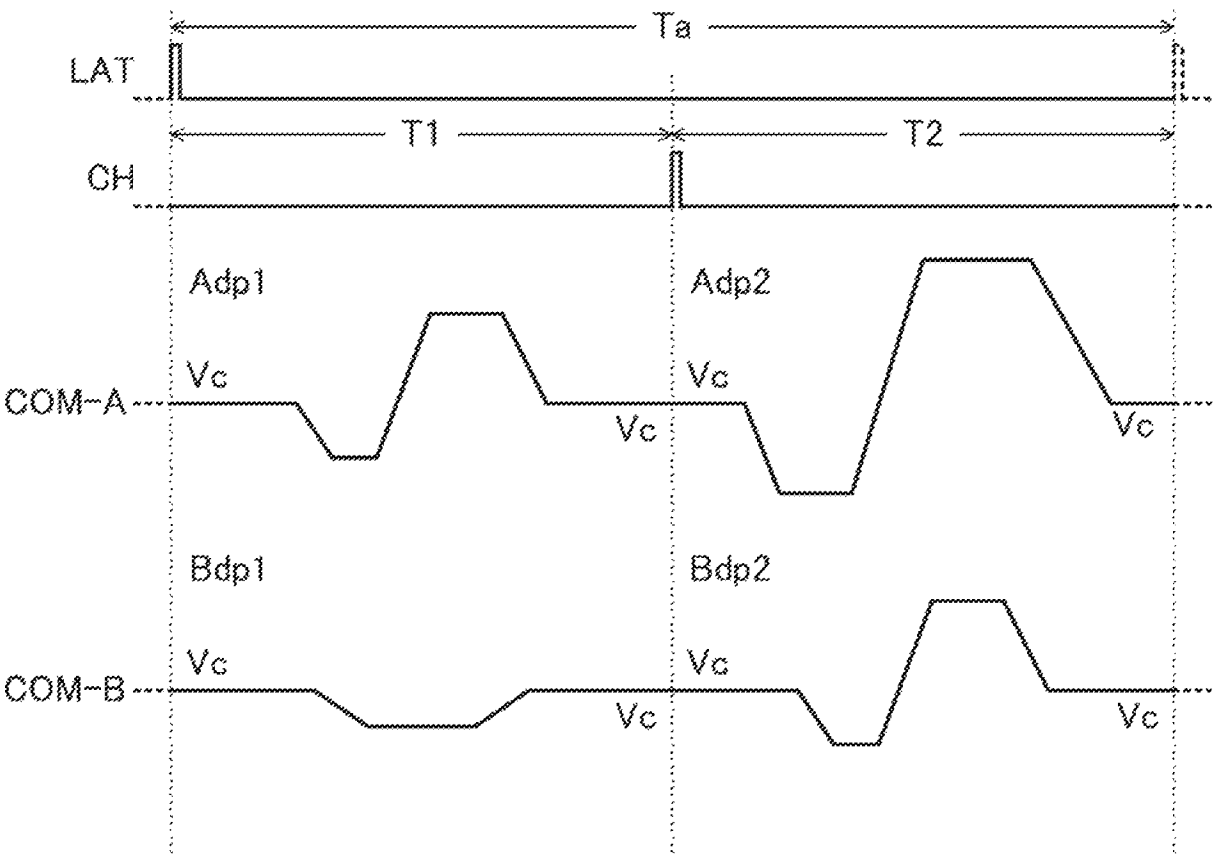
FIG. 8 is a diagram showing examples of waveforms of driving signals.

FIG. 8 is a diagram showing the waveforms of the driving signals COM-A and COM-B. As shown in FIG. 8, the driving signal COM-A has a waveform in which a trapezoidal waveform Adp1 disposed in a period T1 from rise of the latch signal LAT to rise of the change signal CH and a trapezoidal waveform Adp2 disposed in a period T2 from the rise of the change signal CH to the rise of the latch signal LAT are continuous. Then, when the trapezoidal waveform Adp1 is supplied to the one end of the piezoelectric element 60, a small amount of ink is discharged from the discharge portion 600 corresponding to the corresponding piezoelectric element 60. When the trapezoidal waveform Adp2 is supplied to the one end of the piezoelectric element 60, a middle amount of the ink, which is larger than the small amount, is discharged from the discharge portion 600 corresponding to the corresponding piezoelectric element 60.

Further, the driving signal COM-B has a waveform in which a trapezoidal waveform Bdp1 disposed in the period T1 and a trapezoidal waveform Bdp2 disposed in the period T2 are continuous. Then, when the trapezoidal waveform Bdp1 is supplied to the one end of the piezoelectric element 60, the ink is not discharged from the discharge portion 600 corresponding to the corresponding piezoelectric element 60. The trapezoidal waveform Bdp1 is a waveform for finely vibrating the ink near a nozzle opening portion of the discharge portion 600 to prevent an increase in the viscosity of the ink. Further, when the trapezoidal waveform Bdp2 is supplied to the one end of the piezoelectric element 60, the small amount of the ink is discharged from the discharge portion 600 corresponding to the corresponding piezoelectric element 60, which is like a case where the trapezoidal waveform Adp1 is supplied.

Here, all voltages at start timings and termination timings of the trapezoidal waveforms Adp1, Adp2, Bdp1, and Bdp2 are commonly a voltage Vc. That is, each of the trapezoidal waveforms Adp1, Adp2, Bdp1, and Bdp2 is a waveform that starts at the voltage Vc and ends at the voltage Vc. Further, a period Ta including the period T1 and the period T2 corresponds to a printing period during which dots are formed on the medium P.

Although FIG. 8 shows that the trapezoidal waveform Adp1 and the trapezoidal waveform Bdp2 have the same waveform, the trapezoidal waveform Adp1 and the trapezoidal waveform Bdp2 may have different waveforms. Further, in the following description, it is described that the small amount of the ink is discharged both when the trapezoidal waveform Adp1 is supplied to the piezoelectric element 60 and when the trapezoidal waveform Bdp1 is supplied to the piezoelectric element 60. However, the present disclosure is not limited thereto. That is, the waveforms of the driving signals COM-A and COM-B generated by the driving signal generating circuits 310*a* and 310*b* are not limited to the waveforms shown in FIG. 8, and the driving signals COM-A and COM-B may be signals of combinations of various waveforms according to a moving speed of the carriage 71 on which the liquid discharging head 40 is mounted, properties of the discharged ink, and materials of the medium P.

Figure 9:
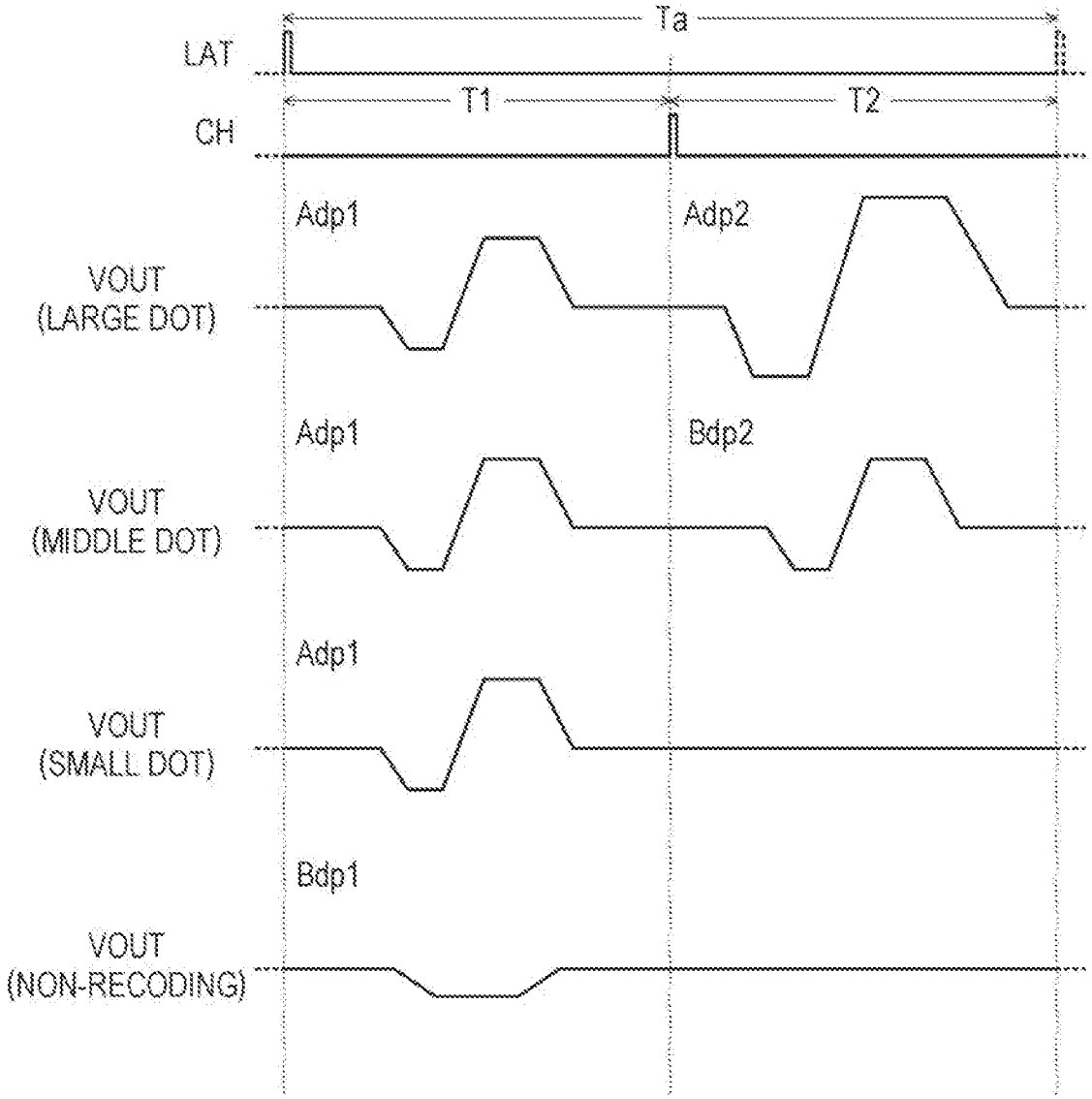
FIG. 9 is a diagram showing examples of waveforms of a driving signal.

FIG. 9 is a diagram showing examples of waveforms of the driving signal VOUT, corresponding to a "large dot", a "middle dot", and a "small dot" formed on the medium P and "non-recording", respectively.

As shown in FIG. 9, the driving signal VOUT corresponding to the "large dot" has a waveform in which, in the period Ta, the trapezoidal waveform Adp1 disposed in the period T1 and the trapezoidal waveform Adp2 disposed in the period T2 are continuous. When the driving signal VOUT is supplied to the one end of the piezoelectric element 60, in the period Ta, the small amount of the ink and the middle amount of the ink are discharged from the discharge portion 600 corresponding to the corresponding piezoelectric element 60. Thus, the ink is landed and coalesced, so that the large dot is formed on the medium P.

The driving signal VOUT corresponding to the "middle dot" has a waveform in which the trapezoidal waveform Adp1 disposed in the period T1 and the trapezoidal waveform Bdp2 disposed in the period T2 are continuous in the period Ta. When the driving signal VOUT is supplied to the one end of the piezoelectric element 60, the small amount of the ink is discharged twice from the discharge portion 600 corresponding to the corresponding piezoelectric element 60 in the period Ta. Thus, the ink is landed and coalesced, so that the middle dot is formed on the medium P.

The driving signal VOUT corresponding to the "small dot" has a waveform in which the trapezoidal waveform Adp1 disposed in the period T1 and a waveform that is disposed in the period T2 and is constant at the voltage Vc are continuous in the period Ta. When the driving signal VOUT is supplied to the one end of the piezoelectric element 60, in the period Ta, the small amount of the ink is discharged from the discharge portion 600 corresponding to the corresponding piezoelectric element 60. Thus, the ink is landed, so that the small dot is formed on the medium P.

The driving signal VOUT corresponding to the "non-recording" has a waveform in which the trapezoidal waveform Bdp1 disposed in the period T1 and a waveform that is disposed in the period T2 and is constant at the voltage Vc are continuous in the period Ta. When the driving signal VOUT is supplied to the one end of the piezoelectric element 60, in the period Ta, the ink near the nozzle opening portion of the discharge portion 600 corresponding to the corresponding piezoelectric element 60 slightly vibrates, so that the ink is not discharged. Thus, as the ink is not landed, no dot is formed on the medium P.

Here, the waveform that is constant at the voltage Vc is a waveform in which when none of the waveforms Adp1, Adp2, Bdp1, and Bdp2 is selected as the driving signal VOUT, the immediately preceding voltage Vc is maintained by a capacitive component of the piezoelectric element 60. Therefore, when none of the trapezoidal waveforms Adp1, Adp2, Bdp1, and Bdp2 is selected as the driving signal VOUT, the voltage Vc as the driving signal VOUT is supplied to the piezoelectric element 60.

Figure 10:
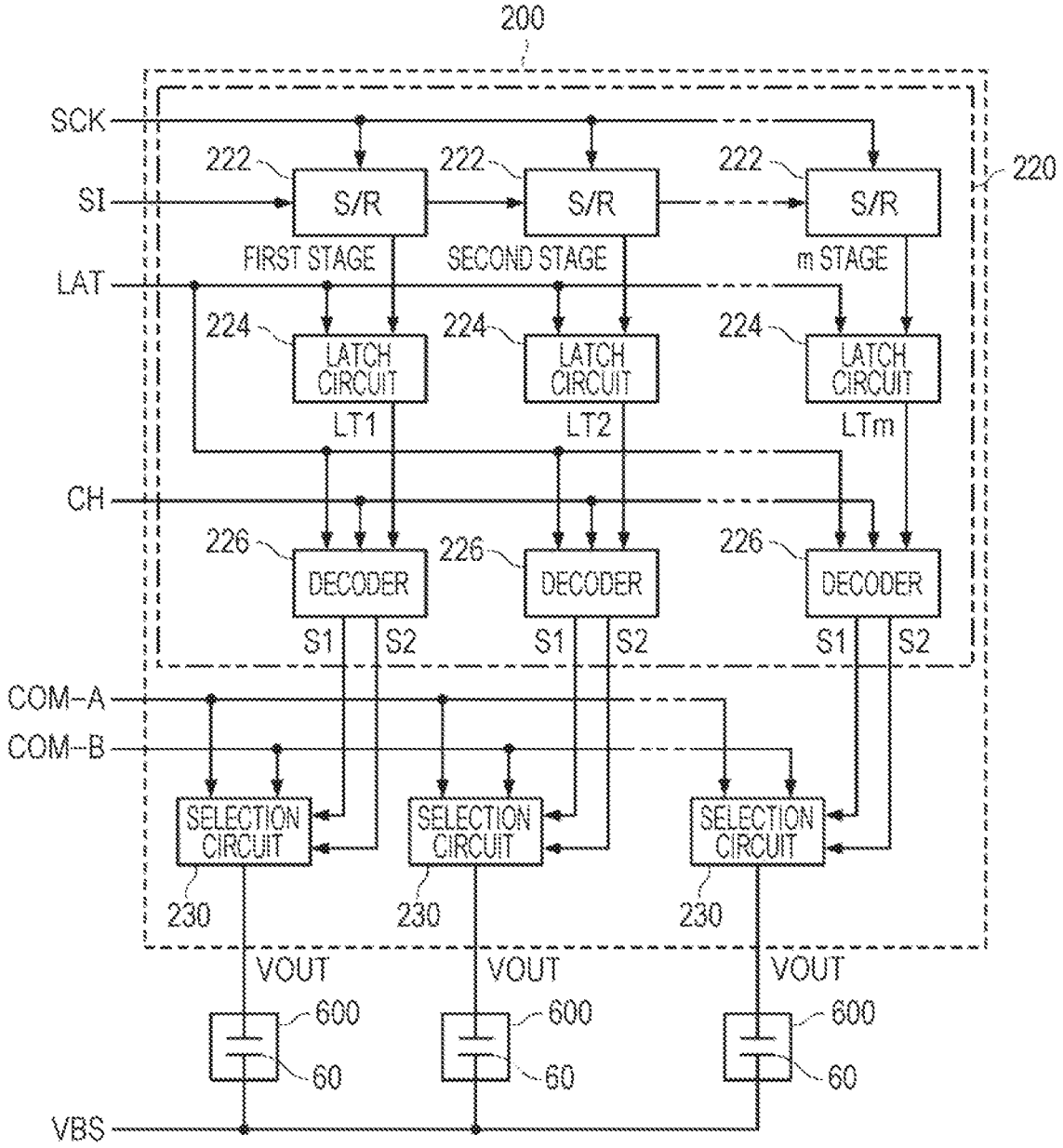
FIG. 10 is a diagram showing a configuration of a driving signal selecting circuit.

Next, a configuration and an operation of the driving signal selecting circuit 200 that selects the waveforms of the driving signals COM-A and COM-B and generates the driving signal VOUT will be described. FIG. is a diagram showing a configuration of the driving signal selecting circuit 200. As shown in FIG. 10, the driving signal selecting circuit 200 includes the selection control circuit 220 and the plurality of selection circuits 230.

The printing data signal SI, the latch signal LAT, the change signal CH, and the clock signal SCK are input to the selection control circuit 220. Further, in the selection control circuit 220, a set of a shift register (S/R) 222, a latch circuit 224, and a decoder 226 is provided in each of the plurality of discharge portions 600. That is, the driving signal selecting circuit 200 includes the sets of the shift registers 222, the latch circuits 224, and the decoders 226, the number of which is the same as the total number m of the corresponding discharge portions 600.

In detail, the printing data signal SI is a signal synchronized with the clock signal SCK, and is a signal having 2m bits totally including 2-bit printing data [SIH, SIL] for selecting any one of the "large dot", the "middle dot", the "small dot", and the "non-recording" with respect to each of the m discharge portions 600. The printing data signal SI is held in the shift register 222 for each 2-bit printing data [SIH, SIL] included in the printing data signal SI, corresponding to the discharge portion 600. In detail, the m stages of the shift registers 222 corresponding to the discharge portions 600 are cascade-connected to each other, and the serially input printing data signal SI is sequentially transferred to the subsequent stage according to the clock signal SCK. In FIG. 10, in order to distinguish the shift registers 222, the shift registers 222 are sequentially represented by a first stage, a second stage, . . . , an m-th stage from an upstream side where the printing data signal SI is input.

The m latch circuits 224 latch the 2-bit printing data [SIH, SIL] held by the m shift registers 222 at rising of the latch signal LAT, respectively.

Figures 11, 12:
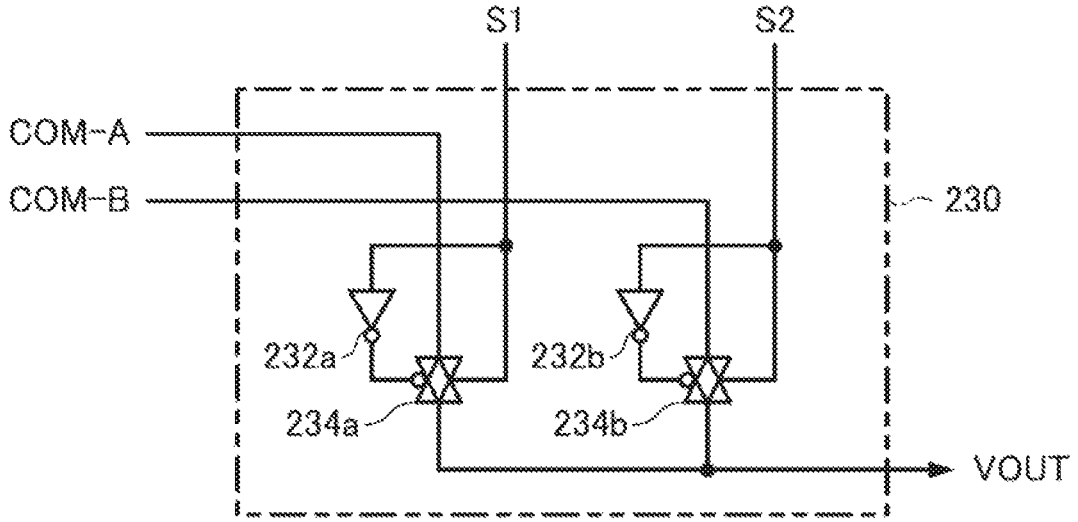
FIG. 11 is a table showing decoding contents in a decoder.
FIG. 12 is a diagram showing a configuration of a selection circuit.

FIG. 11 is a diagram showing decoding contents in the decoder 226. The decoder 226 outputs selection signals S1 and S2 according to the latched 2-bit printing data [SIH, SIL]. For example, when the 2-bit printing data [SIH, SIL] is [1, 0], the decoder 226 outputs a logic level of the selection signal S1 as levels H and L in the periods T1 and T2, and outputs a logic level of the selection signal S2 as levels L and H in the periods T1 and T2 to the selection circuit 230.

The selection circuits 230 are provided to correspond to the discharge portions 600, respectively. That is, the number of the selection circuits 230 included in the driving signal selecting circuit 200 is the same as the total number m of the corresponding discharge portions 600. FIG. 12 is a diagram showing a configuration of the selection circuit 230 corresponding to one discharge portion 600. As shown in FIG. 12, the selection circuit 230 has inverters 232*a* and 232*b* that are NOT circuits and transfer gates 234*a* and 234*b*.

The selection signal S1 is input to a positive control end not marked by a circle in the transfer gate 234*a*, is logically inverted by the inverter 232*a*, and is input to a negative control end marked by a circle in the transfer gate 234*a*. Further, the driving signal COM-A is supplied to an input terminal of the transfer gate 234*a*. The selection signal S2 is input to a positive control end not marked by a circle in the transfer gate 234*b*, is logically inverted by the inverter 232*b*, and is input to a negative control end marked by a circle in the transfer gate 234*b*. Further, the driving signal COM-B is supplied to an input terminal of the transfer gate 234*b*. Then, output terminals of the transfer gates 234*a* and 234*b* are commonly connected to each other, and output the driving signal VOUT.

In detail, the transfer gate 234*a* conducts (on) an input end and an output end when the selection signal S1 is the level H, and does not conduct (off) the input end and the output end when the selection signal S1 is the level L. Further, the transfer gate 234*b* conducts (on) an input end and an output end when the selection signal S2 is the level H, and does not conduct (off) the input end and the output end when the selection signal S2 is the level L. Accordingly, the waveforms of the driving signals COM-A and COM-B are selected based on the selection signals S1 and S2, and the driving signal VOUT is output from the selection circuit 230.

Figure 13:
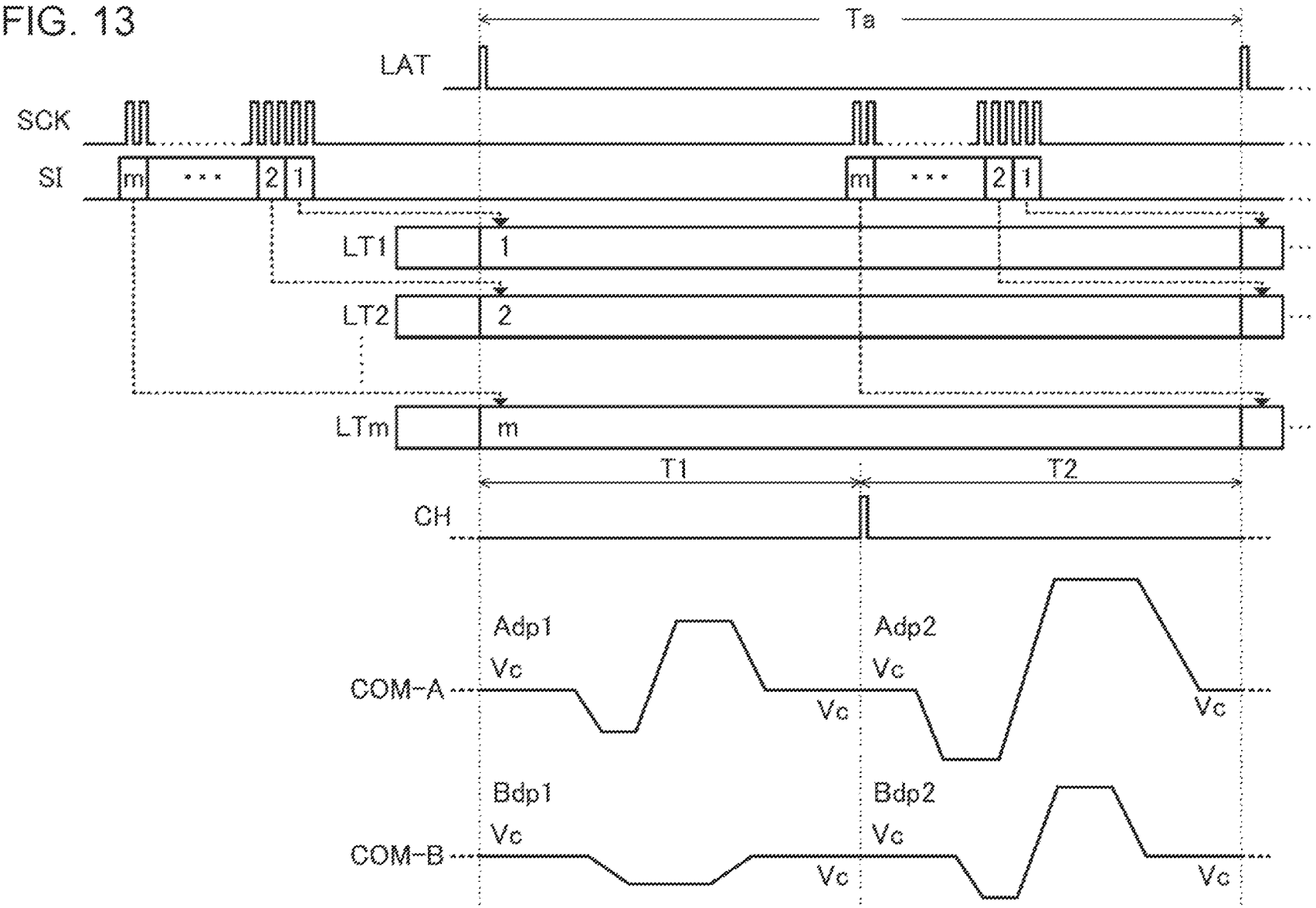
FIG. 13 is a diagram for illustrating an operation of the driving signal selecting circuit.

Here, an operation of the driving signal selecting circuit 200 will be described with reference to FIG. 13. FIG. 13 is a diagram for illustrating the operation of the driving signal selecting circuit 200. The printing data signal SI is serially input in synchronization with the clock signal SCK, and is sequentially transferred in the shift register 222 corresponding to the discharge portion 600. Then, when the input of the clock signal SCK is stopped, the shift registers 222 hold the 2-bit printing data [SIH, SIL] corresponding to the discharge portions 600, respectively. The printing data signal SI is input in an order corresponding to the discharge portions 600 of the m-th stage, . . . , the second stage, and the first stage of the shift registers 222.

Then, when the latch signal LAT rises, the latch circuits 224 latch the 2-bit printing data [SIH, SIL] held in the shift registers 222 all at once, respectively. In FIG. 13, LT1, LT2, . . . , LTm indicate the 2-bit printing data [SIH, SIL] latched by the latch circuits 224 corresponding to the first stage, the second stage, . . . , the m-th stage of the shift registers 222.

The decoder 226 outputs, using the contents shown in FIG. 11, the logic levels of the selection signals S1 and S2 in the periods T1 and T2 according to the size of a dot designated by the latched 2-bit printing data [SIH, SIL].

In detail, when the printing data [SIH, SIL] is [1, 1], the decoder 226 sets the selection signal S1 to levels H and H in the periods T1 and T2, and sets the selection signal S2 to levels L and L in the periods T1 and T2. In this case, the selection circuit 230 selects the trapezoidal waveform Adp1 in the period T1, and selects the trapezoidal waveform Adp2 in the period T2. As a result, the driving signal VOUT corresponding to the "large dot" shown in FIG. 9 is generated.

Further, when the printing data [SIH, SIL] is [1, 0], the decoder 226 sets the selection signal S1 to levels H and L in the periods T1 and T2, and sets the selection signal S2 to levels L and H in the periods T1 and T2. In this case, the selection circuit 230 selects the trapezoidal waveform Adp1 in the period T1, and selects the trapezoidal waveform Bdp2 in the period T2. As a result, the driving signal VOUT corresponding to the "middle dot" shown in FIG. 9 is generated.

Further, when the printing data [SIH, SIL] is [0, 1], the decoder 226 sets the selection signal S1 to levels H and L in the periods T1 and T2, and sets the selection signal S2 to levels L and L in the periods T1 and T2. In this case, the selection circuit 230 selects the trapezoidal waveform Adp1 in the period T1, and selects neither the trapezoidal waveform Adp2 nor the trapezoidal waveform Bdp2 in the period T2. As a result, the driving signal VOUT corresponding to the "small dot" shown in FIG. 9 is generated.

Further, when the printing data [SIH, SIL] is [0, 0], the decoder 226 sets the selection signal S1 to levels L and L in the periods T1 and T2, and sets the selection signal S2 to levels H and L in the periods T1 and T2. In this case, the selection circuit 230 selects the trapezoidal waveform Bdp1 in the period T1, and selects neither the trapezoidal waveform Adp2 nor the trapezoidal waveform Bdp2 in the period T2. As a result, the driving signal VOUT corresponding to "non-recording" shown in FIG. 9 is generated.

As described above, the driving signal selecting circuit 200 selects waveforms of the driving signals COM-A and COM-B based on the printing data signal SI, the latch signal LAT, the change signal CH, and the clock signal SCK, and outputs the driving signal VOUT. In other words, the driving signal selecting circuit 200 controls supply of the driving signals COM-A and COM-B to the piezoelectric element 60.

5. Configuration of Driving Signal Generating Circuit

Next, configurations and operations of the driving signal generating circuits 310*a* and 310*b* that generate and output the driving signals COM-A and COM-B will be described. Here, the driving signal generating circuits 310*a* and 310*b* differ from each other only in that input signals are the base driving signals dA and dB and output signals are the driving signals COM-A and COM-B, and have the same configuration and the same operation. Therefore, in the following description, the driving signal generating circuit 310*a* will be described, and the configuration and the operation of the driving signal generating circuit 310*b* will be omitted.

Figure 14:
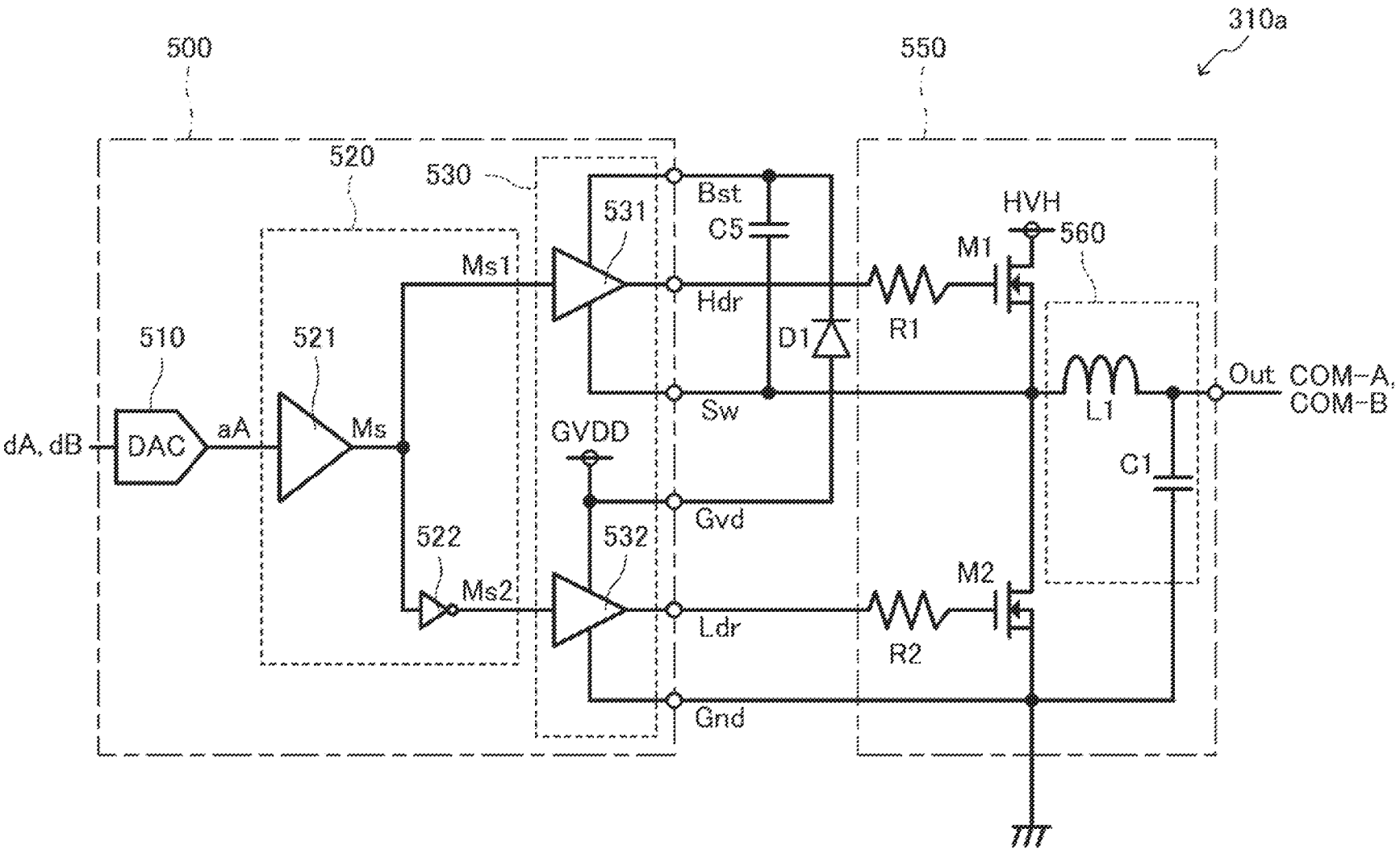
FIG. 14 is a diagram showing a configuration of a driving signal generating circuit.

FIG. 14 is a diagram showing the configuration of the driving signal generating circuit 310*a*. As shown in FIG. 14, the driving signal generating circuit 310*a* includes an integrated circuit device 500, an output circuit 550, and a plurality of circuit elements.

The integrated circuit device 500 outputs gate signals for driving transistors M1 and M2 included in the output circuit 550 based on the input base driving signal dA. The integrated circuit device 500 includes a digital to analog converter (DAC) 510, a modulation circuit 520, and a gate driving circuit 530.

The base driving signal dA is input to the DAC 510. Then, the DAC 510 performs digital/analog conversion on the base driving signal dA, and generates the base driving signal aA of an analog signal. A signal obtained by amplifying the voltage of the base driving signal aA is the driving signal COM-A. In other words, the base driving signal aA is a target signal before the amplification of the driving signal COM-A.

The modulation circuit 520 includes a comparator 521 and an inverter circuit 522. The base driving signal aA is input to the comparator 521. Then, the comparator 521 outputs a modulation signal Ms that becomes the level H when a voltage value of the base driving signal aA is equal to or higher than a predetermined voltage threshold Vth1 in a case where the voltage value of the base driving signal aA is rising, and becomes the level L when the voltage value of the base driving signal aA is lower than a predetermined voltage threshold Vth2 in a case where the voltage value of the base driving signal aA is decreasing. The above-described threshold is set to have a relationship of the voltage threshold Vth1>the voltage threshold Vth2.

After the modulation signal Ms output from the comparator 521 is branched in the modulation circuit 520, one branched modulation signal Ms is output to the gate driving circuit 530 as a modulation signal Ms1. Further, the other branched modulation signal Ms is output to the gate driving circuit 530 through the inverter circuit 522 as a modulation signal Ms2. That is, the modulation circuit 520 generates two modulation signals Ms1 and Ms2 having exclusive logic levels, and outputs the generated modulation signals Ms1 and Ms2 to the gate driving circuit 530. Here, the two signals having the exclusive logic level include signals, a timing of which is controlled such that the logic levels of the two signals do not simultaneously become the level H.

The gate driving circuit 530 includes a gate driver 531 and a gate driver 532. The gate driver 531 level-shifts a voltage value of the modulation signal Ms1 output from the modulation circuit 520 and outputs the level-shifted voltage from a terminal Hdr. In detail, among the power supply voltages of the gate driver 531, a voltage is supplied to a high potential side through a terminal Bst, and a voltage is supplied to a low potential side through a terminal Sw. The terminal Bst is commonly connected to one end of a capacitor C5 provided outside the integrated circuit device 500 and a cathode terminal of a diode D1 for preventing backflow. Further, the other end of the capacitor C5 is connected to the terminal Sw. Further, an anode terminal of the diode D1 is connected to a terminal Gvd. Then, the voltage GVDD generated by the voltage converting circuit 330 shown in FIG. 5 is supplied to the terminal Gvd. Therefore, a potential difference between the terminal Bst and the terminal Sw is approximately equal to a potential difference between both ends of the capacitor C5, that is, the voltage GVDD. Then, the gate driver 531 generates a signal, a voltage value of which is larger than that of the terminal Sw by the voltage GVDD according to the input modulation signal Ms1, and outputs the generated signal from the terminal Hdr.

The gate driver 532 operates at a lower potential side than that of the gate driver 531. The gate driver 532 level-shifts a voltage value of the modification signal Ms2 output from the modulation circuit 520, and outputs the level-shifted voltage value from a terminal Ldr. In detail, among the power supply voltages of the gate driver 532, the voltage GVDD is supplied to a high potential side, and the ground potential is supplied to a low potential side. Then, the gate driver 532 generates a signal, a voltage value of which is larger than that of a terminal Gnd by the voltage GVDD according to the input modulation signal Ms2, and outputs the generated signal from the terminal Ldr.

The output circuit 550 includes transistors M1 and M2, resistors R1 and R2, and a low pass filter circuit 560. Each of the transistors M1 and M2 is, for example, an N-channel field effect transistor (FET).

The voltage HVH is supplied to a drain electrode of the transistor M1. Further, a gate electrode of the transistor M1 is connected to one end of the resistor R1, and the other end of the resistor R1 is connected to the terminal Hdr. Further, a source electrode of the transistor M1 is connected to the terminal Sw. The transistor M1 connected as described above operates according to an output signal of the gate driver 531 output from the terminal Hdr.

A drain electrode of the transistor M2 is connected to the source electrode of the transistor M1. Further, a gate electrode of the transistor M2 is connected to one end of the resistor R2, and the other end of the resistor R2 is connected to the terminal Ldr. Further, the ground potential is supplied to a source electrode of the transistor M2. The transistor M2 connected as described above operates according to an output signal of the gate driver 532 output from the terminal Ldr.

When the transistor M1 is controlled to be switched off, and the transistor M2 is controlled to be switched on, a connection point to which the terminal Sw is connected has the ground potential. Therefore, the voltage GVDD is supplied to the terminal Bst. Meanwhile, when the transistor M1 is controlled to be switched on, and the transistor M2 is controlled to be switched off, the voltage HVH is supplied to a connection point to which the terminal Sw is connected. Therefore, the voltage HVH and the voltage GVDD are supplied to the terminal Bst.

That is, the gate driver 531 for driving the transistor M1 uses the capacitor C5 as a floating power supply, and the voltage of the terminal Sw changes to the ground potential or the voltage HVH according to the operation of the transistors M1 and M2. Thus, in the level L, the voltage HVH is supplied to the gate electrode of the transistor M1, and in the level H, a signal of the voltage HVH and the potential GVDD is supplied to the gate electrode of the transistor M1. Then, the transistor M1 performs a switching operation based on the signal supplied to the gate electrode. Further, the gate driver 532 for driving the transistor M2 supplies the ground potential to the gate electrode of the transistor M2 at the level L and supplies a signal of the voltage GVDD to the gate electrode of the transistor M2 at the level H, regardless of the operation of the transistors M1 and M2. Then, the transistor M2 performs a switching operation based on the signal supplied to the gate electrode. Accordingly, an amplification modulation signal obtained by amplifying the modulation signal Ms based on the voltage HVH is generated at a connection point between the source electrode of the transistor M1 and the drain electrode of the transistor M2.

The low pass filter circuit 560 includes a coil L1 and a capacitor C1. One end of the coil L1 is commonly connected to the source electrode of the transistor M1 and the drain electrode of the transistor M2. Further, the other end of the coil L1 is commonly connected to a terminal Out from which the driving signal COM-A is output and one end of the capacitor C1. The ground potential is supplied to the other end of the capacitor C1.

The coil L1 and the capacitor C1 connected as described above smooth the amplification modulation signal supplied to the connection point between the transistors M1 and M2. Accordingly, the driving signal COM-A is generated by demodulating the amplification modulation signal. Then, the generated driving signal COM-A is output from the terminal Out.

A configuration of the driving signal generating circuit 310*a* shown in FIG. 14 is an example. For example, a plurality of feedback circuits for stabilizing the operation of the driving signal generating circuit 310*a* may be included. Further, in FIG. 14, description is made using a class D amplifier circuit as an example of the driving signal generating circuit 310*a*. However, the driving signal generating circuit 310*a* may have any configuration as long as the configuration can amplify the waveform of the base driving signal aA, and may be, for example, a class A amplification circuit, a class B amplification circuit, a class AB amplification circuit, and the like.

6. Waveform Distortion of Parasitic Inductance Component and Parasitic Resistance Component of Driving Signal In the above-described liquid ejecting apparatus 1, the driving signal generating circuits 310*a* and 310*b* generate the driving signals COM-A and COM-B to output the generated driving signals COM-A and COM-B to the piezoelectric element 60. However, the waveforms of the driving signals COM-A and COM-B may be distorted due to a resistance component and an inductance component of a path through which the driving signals COM-A and COM-B are propagated. Such distortion of the waveform may reduce a discharge speed of the ink discharged from the nozzle 651. As a result, printing quality of the liquid ejecting apparatus 1 may be reduced.

Here, a relationship between the discharge speed of the ink discharged from the nozzle 651 and the distortion of the waveforms of the driving signals COM-A and COM-B, which may be generated due to the resistance component and the inductance component of the path through which the driving signals COM-A and COM-B are propagated, will be described with reference to FIGS. 15 to 18. Here, in description of FIGS. 15 to 18, the driving signals COM-A and COM-B are referred to as a driving signal COM. Further, it is described that the driving signal COM is generated by the driving signal generating circuit 310. The waveform of the driving signal COM shown in FIGS. 15 and 17 is an example, and may be any one of, for example, the trapezoidal waveforms Adp1, Adp2, Bdp1, and Bdp2 shown in FIG. 8.

Figure 15:
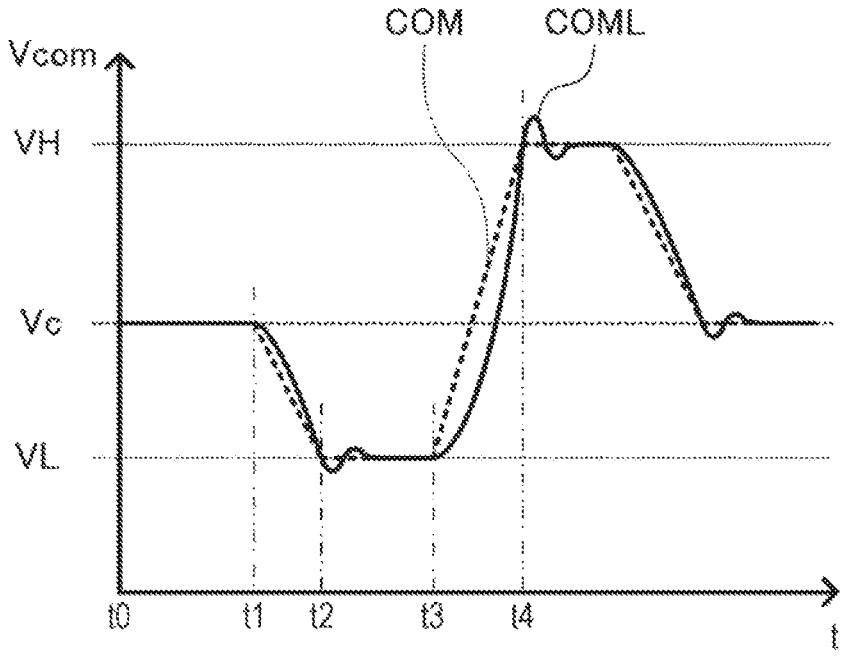
FIG. 15 is a diagram showing a relationship between a driving signal output from the driving signal generating circuit and a driving signal supplied to a piezoelectric element.

FIG. 15 is a diagram showing a relationship between a driving signal COML supplied to the piezoelectric element 60 and an example of the waveform of the driving signal COM output from the driving signal generating circuit 310 when the inductance component of the path through which the driving signal COM is propagated is dominant. A vertical axis of FIG. 15 indicates a voltage Vcom as voltage values of the driving signals COM and COML, and a transverse axis of FIG. 15 indicates a time t.

As shown in FIG. 15, in a time t0, the voltage value of the driving signal COM generated by the driving signal generating circuit 310 is set as the voltage Vc, and at this time, the voltage value of the driving signal COML is also set as the voltage Vc.

The voltage value of the driving signal COM drops from the voltage Vc in a time t1, and becomes a voltage VL at a time t2. The voltage value of the driving signal COML late drops from the time t1 due to release of charges stored in the capacitive component of the piezoelectric element 60. Then, the voltage value of the driving signal COML approaches the voltage value of the driving signal COM according to the release of the charges stored in the piezoelectric element 60. At the time t2, when the voltage value of the driving signal COM becomes constant at a voltage VL, the voltage value of the driving signal COML releases energy stored in the inductance component by current flowing in a propagation path through which the driving signal COM is propagated. Therefore, the voltage value of the driving signal COML falls below the voltage VL due to the release of the energy. Then, after the release of the energy is completed, the voltage value of the driving signal COML approaches the voltage VL. That is, when the inductance component is dominant in the path through which the driving signal COM is propagated, an undershoot voltage may occur in the driving signal COML.

Further, the voltage value of the driving signal COM rises from the voltage VL at a time t3, and becomes a voltage VH at a time t4. The voltage value of the driving signal COML late rises at a time t3 since charges are stored in the capacitive component of the piezoelectric element 60. Then, as charges are stored in the capacitive component of the piezoelectric element 60, the voltage value of the driving signal COML approaches the voltage of the driving signal COM. At the time t4, when the voltage value of the driving signal COM becomes constant at the voltage VH, the voltage value of the driving signal COML releases the energy stored in the inductance component by the current flowing in the propagation path through which the driving signal COM is propagated. Therefore, the voltage value of the driving signal COML exceeds the voltage VH due to the release of the energy. Then, after the release of the energy is completed, the voltage value of the driving signal COML approaches the voltage VH. That is, when the inductance component is dominant in the path through which the driving signal COM is propagated, an overshoot voltage may occur in the driving signal COML.

As described above, when the inductance component is dominant in the path through which the driving signal COM is propagated, an undershoot voltage and an overshoot voltage may occur in the driving signal COML supplied to the piezoelectric element 60. As a result, displacement of the piezoelectric element 60 is increased, and a discharge speed of the ink discharged from the nozzle 651 is increased.

Figure 16:
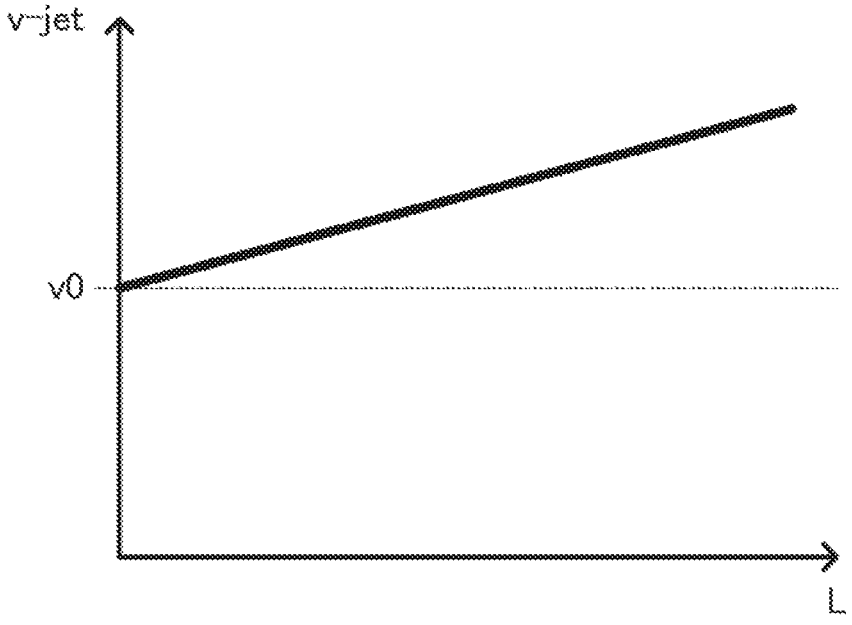
FIG. 16 is a diagram showing a relationship between an inductance component including a parasitic inductance component and a discharge speed.
Figure 17:
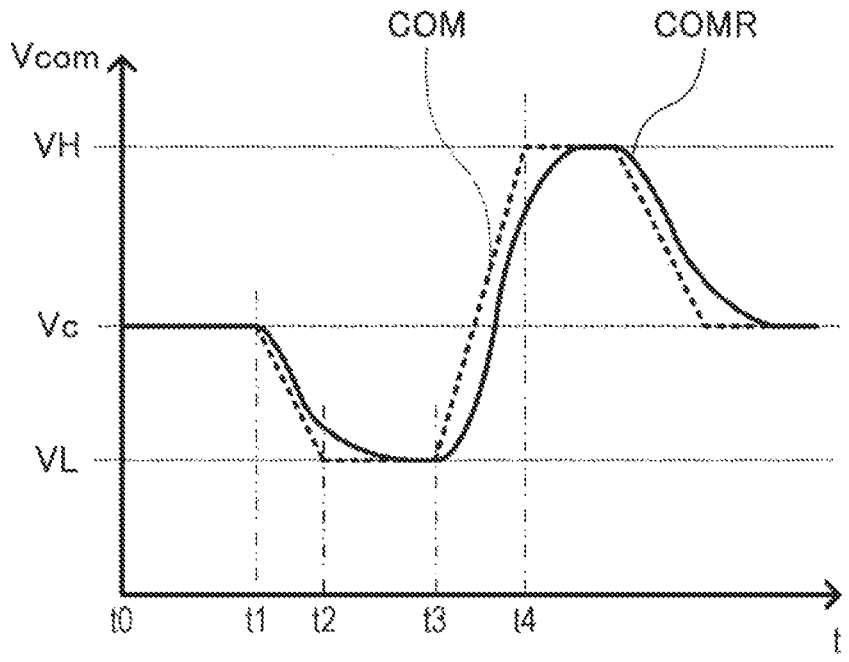
FIG. 17 is a diagram showing a relationship between the driving signal output from the driving signal generating circuit and a driving signal supplied to a piezoelectric element.

FIG. 16 is a diagram showing a relationship between an inductance component L and a discharge speed v-jet in the path through which the driving signal COM is propagated. The overshoot voltage and the undershoot voltage occurring in the driving signal COML as described above increase as the inductance component of the path through which the driving signal COM is propagated increases. That is, as the inductance component increases, the displacement of the piezoelectric element 60 increases. Therefore, as shown in FIG. 16, as the inductance component in the path through which the driving signal COM is propagated increases, the discharge speed v-jet of the ink becomes faster.

FIG. 17 is a diagram showing a relationship between a driving signal COMR supplied to the piezoelectric element 60 and an example of the waveform of the driving signal COM output from the driving signal generating circuit 310 when the resistance component is dominant in the path through which the driving signal COM is propagated. A vertical axis of FIG. 17 indicates the voltage Vcom as the voltage values of the driving signals COM and COMR, and a transverse axis of FIG. 17 indicates the time t.

As shown in FIG. 17, at the time t0, the voltage value of the driving signal COM generated by the driving signal generating circuit 310 is the voltage Vc. At this time, the voltage value of the driving signal COMR is also the voltage Vc.

The voltage value of the driving signal COM drops from the voltage Vc at the time t1, and becomes the voltage VL at the time t2. The voltage value of the driving signal COMR late drops from the time t1 due to release of charges stored in the capacitive component of the piezoelectric element 60. Then, the voltage value of the driving signal COMR approaches the voltage value of the driving signal COM according to the release of the charges stored in the piezoelectric element 60. However, when the resistance component is dominant in the path through which the driving signal COM is propagated, the release of the charges stored in the piezoelectric element 60 is inhibited by the resistance component. Therefore, the voltage value of the driving signal COMR late reaches the voltage VL from the time t2 when the voltage value of the driving signal COM is constant at the voltage VL.

Further, the voltage value of the driving signal COM rises from the voltage VL at the time t3, and becomes the voltage VH at the time t4. The voltage value of the driving signal COMR late rises from the time t3 since charges are stored in the capacitive component of the piezoelectric element 60. Then, as the charges are stored in the capacitive component of the piezoelectric element 60, the voltage value of the driving signal COMR approaches the voltage of the driving signal COM. However, when the resistance component of the path through which the driving signal COM is propagated is dominant, accumulation of charges in the piezoelectric element 60 is inhibited by the resistance component. Therefore, the voltage value of the driving signal COMR late reaches the voltage VH from the time t4 when the voltage value of the driving signal COM becomes constant at the voltage VH.

As described above, when the resistance component is dominant in the path through which the driving signal COM is propagated, the driving signal COMR supplied to the piezoelectric element 60 is delayed with respect to the driving signal COM. As a result, a sufficient voltage is not supplied to the piezoelectric element 60, the displacement of the piezoelectric element 60 is reduced, and the discharge speed of the ink discharged from the nozzle 651 is reduced.

Figure 18:
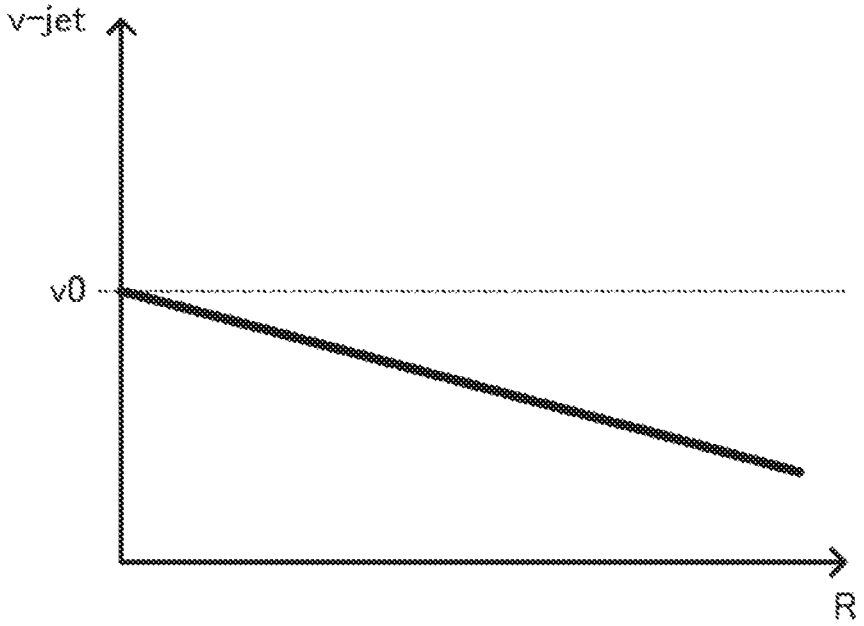
FIG. 18 is a diagram showing a relationship between a resistance component including a parasitic resistance component and the discharge speed.

FIG. 18 is a diagram showing a relationship between the resistance component R and the discharge speed v-jet in the path through which the driving signal COM is propagated. The delay of the signal generated in the driving signal COMR as described above increases as the resistance component of the path through which the driving signal COM is propagated increases. That is, as the resistance component increases, the displacement of the piezoelectric element 60 decreases. Therefore, as shown in FIG. 18, as the resistance component in the path through which the driving signal COM is propagated increases, the discharge speed v-jet of the ink is reduced.

As described above, the discharge speed v-jet of the ink is increased by influence of the inductance component of the path through which the driving signal COM is propagated, and the discharge speed v-jet of the ink is decreased by influence of the resistance component of the path. In other words, the discharge speed v-jet of the ink fluctuates due to balance between the inductance component and the resistance component of the path through which the driving signal COM is propagated. Then, when the resistance component is dominant in the path through which the driving signal COM is propagated, the discharge speed v-jet of the ink is reduced. When the discharge speed v-jet of the ink is reduced, discharge accuracy of the ink discharged from the liquid discharging head 40 may deteriorate. As a result, the discharge accuracy of the ink of the liquid ejecting apparatus 1 may deteriorate.

Here, the piezoelectric element 60 is displaced by the above-described potential difference between the electrode 611 and the electrode 612. That is, the discharge speed v-jet of the ink fluctuates due to the potential difference between the electrode 611 and the electrode 612. Therefore, the inductance component and the resistance component that affect the fluctuation of the discharge speed v-jet of the ink are an inductance component and a resistance component of the path through which the driving signal COM is propagated, specifically, a path through which a current generated by supplying the driving signal COM to the piezoelectric element 60 flows.

7. Configuration of Driving Circuit for Driving Capacitive Load

Figure 19:
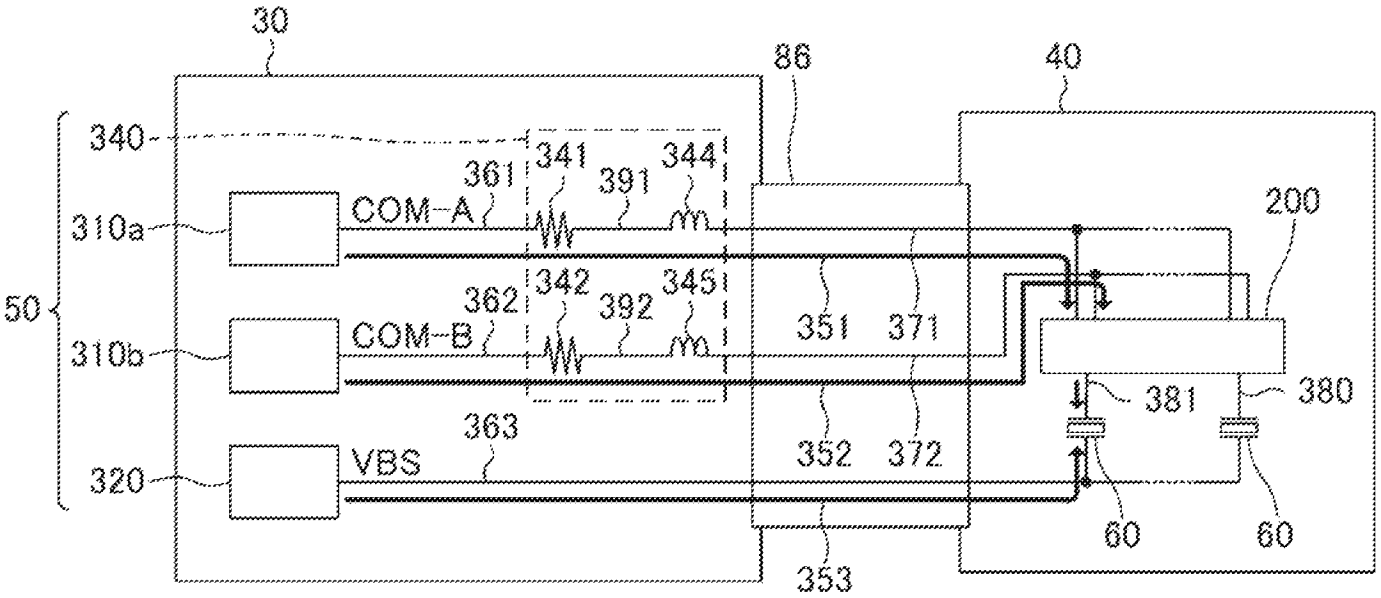
FIG. 19 is a diagram for illustrating a configuration and an operation of a driving circuit for driving a capacitive load.

As shown in FIG. 19, the liquid ejecting apparatus 1 according to the present embodiment includes a correction circuit 340 that corrects distortion of a waveform generated in the driving signals COM-A and COM-B due to the resistance component, with respect to risk that the discharge speed v-jet of the ink decreases as described above. In detail, the liquid ejecting apparatus 1 includes the driving signal generating circuits 310*a* and 310*b*, the reference voltage signal generating circuit 320, wires 361, 362, and 363, and the correction circuit 340, as a driving circuit 50 for driving the piezoelectric element 60 that is a capacitive load. Further, the correction circuit 340 has resistors 341 and 342 and coils 344 and 345. Then, the wire 361 is electrically coupled to the driving signal generating circuit 310*a* to propagate the driving signal COM-A to the electrode 611 that is one end of the piezoelectric element 60 through the resistor 341 and the coil 344, the wire 362 is electrically coupled to the driving signal generating circuit 310*b* to propagate the driving signal COM-B to the electrode 611 that is one end of the piezoelectric element 60 through the resistor 342 and the coil 345, and the wire 363 is electrically coupled to the reference voltage signal generating circuit 320 to propagate the reference voltage signal VBS to the electrode 612 that is the other end of the piezoelectric element 60.

Here, a configuration and an operation of the driving circuit 50 will be described in detail with reference to FIG. 19. FIG. 19 is a diagram for illustrating the configuration and the operation of the driving circuit 50 for driving a capacitive load. As shown in FIG. 19, the driving circuit 50 includes the driving signal generating circuits 310*a* and 310*b*, the reference voltage signal generating circuit 320, and the correction circuit 340, provided on a substrate 300.

The driving signal generating circuit 310*a* is electrically coupled to one end of the wire 361. The other end of the wire 361 is electrically coupled to one end of the resistor 341. The other end of the resistor 341 is electrically coupled to one end of the coil 344. The other end of the coil 344 is electrically coupled to one end of a wire 371. The other end of the wire 371 is electrically coupled to the driving signal selecting circuit 200. Further, the driving signal generating circuit 310*b* is electrically coupled to one end of the wire 362. The other end of the wire 362 is electrically coupled to one end of the resistor 342. The other end of the resistor 342 is electrically coupled to one end of the coil 345. The other end of the coil 345 is electrically coupled to one end of a wire 372. The other end of the wire 372 is electrically coupled to the driving signal selecting circuit 200. Accordingly, the driving signal COM-A is input to the driving signal selecting circuit 200 through a propagation path 351 including the wire 361, the resistor 341, the coil 344, and the wire 371, and the driving signal COM-B is input to the driving signal selecting circuit 200 through a propagation path 352 including the wire 362, the resistor 342, the coil 345, and the wire 372.

Here, the wire 361 through which the driving signal COM-A is propagated is an example of a first wire, the coil 344 included in the propagation path 351 including the wire 361 is an example of a first coil, and the resistor 341 is an example of a resistive element. Further, the wire 362 through which the driving signal COM-B is propagated is an example of a second wire, and the coil 345 included in the propagation path 352 including the wire 362 is an example of a second coil. Further, the coils 344 and 345 added as the correction circuit 340 correct waveform distortion caused by the resistance component generated in the driving signals COM-A and COM-B. That is, the coils 344 and 345 are provided separately from a coil L1 included in the driving signal generating circuits 310*a* and 310*b* for generating the driving signals COM-A and COM-B.

Then, the driving signals COM-A and COM-B input to the driving signal selecting circuit 200 are propagated through a wire 381 as the driving signal VOUT, and are then supplied to the electrode 611 that is the one end of the piezoelectric element 60. That is, the driving signal COM-A generated by the driving signal generating circuit 310*a* is propagated by the wire 361 and is supplied to the piezoelectric element 60 through the resistor 341 and the coil 344, and the driving signal COM-B generated by the driving signal generating circuit 310*b* is propagated by the wire 362 and is supplied to the electrode 611 that is the one end of the piezoelectric element 60 through the resistor 342 and the coil 345.

The reference voltage signal generating circuit 320 is electrically coupled to one end of the wire 363. The other end of the wire 363 is electrically coupled to the electrode 612 that is the other end of the piezoelectric element 60. Accordingly, the reference voltage signal VBS generated by the reference voltage signal generating circuit 320 is supplied to the electrode 612 that is the other end of the piezoelectric element 60 through a propagation path 353 including the wire 363.

A current generated as the driving signal COM-A generated by the driving signal generating circuit 310*a* is supplied to the piezoelectric element 60 flows through the propagation paths 351 and 353. That is, the current flowing through the piezoelectric element 60 flows through the coil 344 included in the propagation path 351. Further, the current generated as the driving signal COM-B generated by the driving signal generating circuit 310*b* is supplied to the piezoelectric element 60 flows through the propagation paths 352 and 353. That is, the current flowing through the piezoelectric element 60 flows through the coil 345 included in the propagation path 352. As described above, even when the coils 344 and 345 are included in a path of the current flowing through the piezoelectric element 60, and a parasitic resistance component such as wiring resistance is dominant in the corresponding path, balance between a resistance component and an inductance component of the corresponding path can be adjusted by the coils 344 and 345, and possibility that the discharge speed v-jet of the ink is reduced can decrease.

Here, when the waveform of the driving signal COM-A and the waveform of the driving signal COM-B as shown in the present embodiment are different from each other, the inductance values of the coil 344 and the coil 345 may be different values.

When the waveforms of the driving signals COM-A and COM-B are different from each other, the discharge speed v-jet of the ink discharged from the nozzle corresponding to the piezoelectric element 60 to which the driving signal VOUT is supplied based on the driving signal COM-A is different from the discharge speed v-jet of the ink discharged from the nozzle corresponding to the piezoelectric element 60 to which the driving signal VOUT is supplied based on the driving signal COM-B. The coil 344 is included in the propagation path 351 through which the driving signal COM-A is propagated, the coil 345 is included in the propagation path 352 through which the driving signal COM-B is propagated, and different inductance values are selected in the propagation paths 351 and 352, respectively, so that the discharge speeds v-jet of the ink can be individually adjusted. Therefore, a difference between the discharge speed v-jet of the ink discharged from the nozzle corresponding to the piezoelectric element 60 to which the driving signal VOUT is supplied based on the driving signal COM-A and the discharge speed v-jet of the ink discharged from the nozzle corresponding to the piezoelectric element 60 to which the driving signal VOUT is supplied based on the driving signal COM-B can be reduced.

Here, the fact that the waveforms of the driving signals COM-A and COM-B are different from each other means that even when a difference between the driving signal generating circuits 310*a* and 310*b* is considered, the waveforms of the driving signal generating circuits 310*a* and 310*b* are not identical to each other. As an example where the waveforms of the driving signals COM-A and COM-B are different from each other, the waveforms provided such that the amount of the ink discharged as the driving signal COM-A is supplied and the amount of the ink discharged as the driving signal COM-B is supplied are different from each other when the ink discharged as the driving signal COM-A is supplied to the piezoelectric element 60 and the ink discharged as the driving signal COM-B is supplied to the piezoelectric element 60 are the same, the waveforms provided such that the amount of the ink discharged as the driving signal COM-A is supplied and the amount of the ink discharged as the driving signal COM-B is supplied are the same when properties, such as viscosity, of the ink discharged as the driving signal COM-A is supplied and the ink discharged as the driving signal COM-B is supplied are different from each other, and the like are included. Further, the fact that the inductance values of the coil 344 and the coil 345 are different from each other means that a rated inductance value of the coil 344 and a rated inductance value of the coil 345 are different from each other.

Further, as shown in FIG. 19, it is preferable that the resistor 341 is included in the propagation path 351 through which the driving signal COM-A is propagated and the resistor 342 is included in the propagation path 352 through which the driving signal COM-B is propagated. The resistors 341 and 342 in addition to the coils 344 and 345 are included in the propagation paths 351 and 352 through which the driving signals COM-A and COM-B are propagated, respectively, so that adjustment accuracy of the balance between the resistance component and the inductance component in the propagation paths 351 and 352 can be improved. Therefore, when the inductance value fluctuates due to the current flowing through the propagation paths 351 and 352 or when the number of the piezoelectric elements 60 to which the driving signals COM-A and COM-B are supplied fluctuates, it is possible to reduce the fluctuation of the discharge speed v-jet of the ink with respect to a change in the capacitive component.

Further, as shown in FIG. 19, it is preferable that the correction circuit 340 including the resistors 341 and 342 and the coils 344 and 345 is provided in the driving circuit board 30.

The resistor 341 and the coil 344 generate heat due to the current generated as the driving signal COM-A is supplied to the piezoelectric element 60. Similarly, the resistor 342 and the coil 345 generate heat due to the current generated as the driving signal COM-B is supplied to the piezoelectric element 60. Therefore, when the correction circuit 340 is provided in the liquid discharging head 40, heat generated by the correction circuit 340 is applied to the ink filled in the liquid discharging head 40, which may affect properties, such as viscosity, of the ink. As shown in FIG. 19, the correction circuit 340 is provided in the driving circuit board 30, so that the amount of heat generated by the resistors 341 and 342 and a coil 343 and applied to the ink can be reduced.

Figure 20:
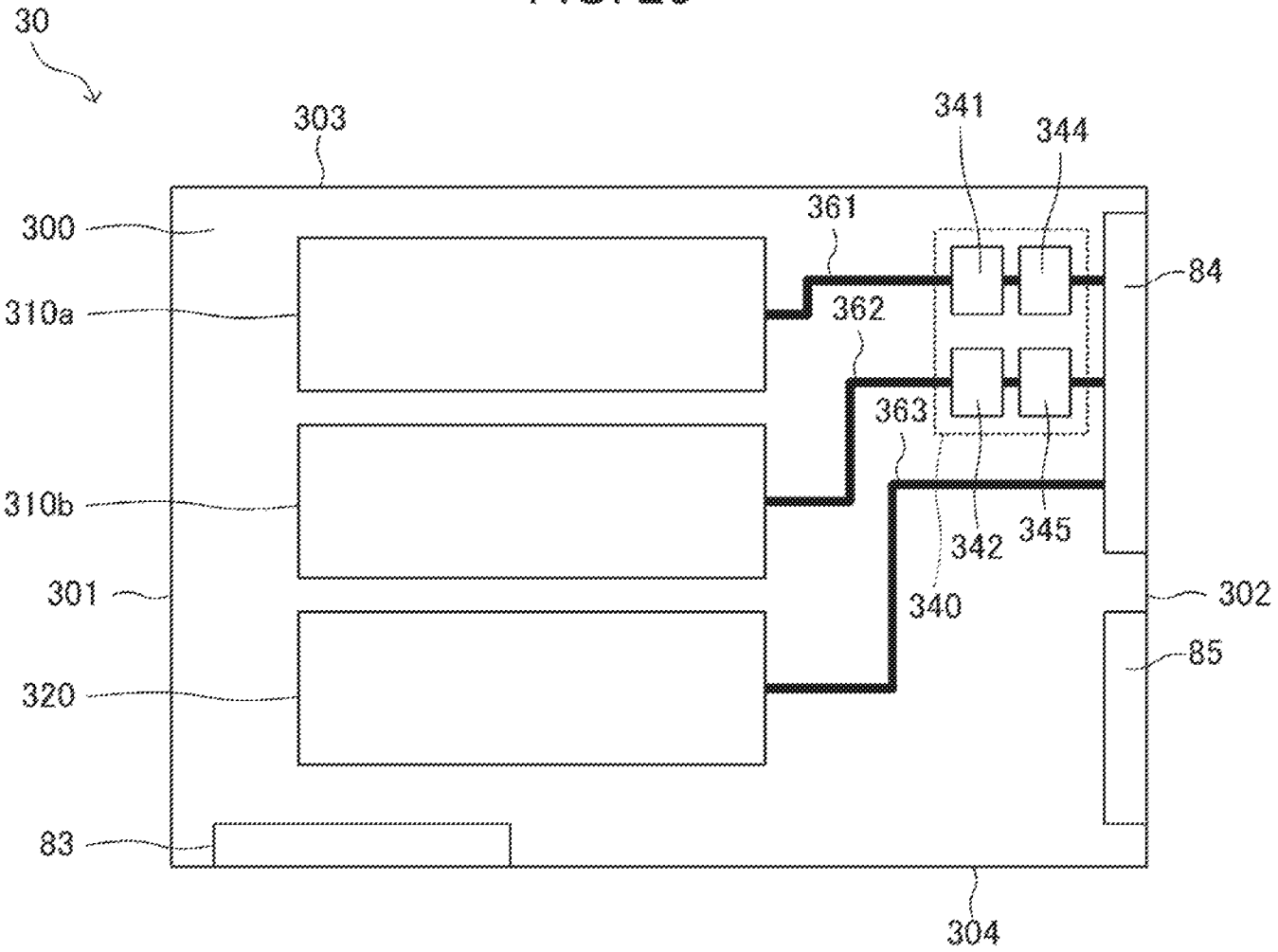
FIG. 20 is a diagram showing a configuration of a driving circuit board.

Here, a configuration of the driving circuit board 30 will be described with reference to FIG. 20. FIG. 20 is a diagram showing the configuration of the driving circuit board 30. As shown in FIG. 20, the driving circuit board 30 has the substrate 300, the correction circuit 340, the driving signal generating circuits 310*a* and 310*b*, the reference voltage signal generating circuit 320, the connectors 83, 84, and 85, and a plurality of wires. The substrate 300 has a substantially rectangular shape having a side 301, a side 302 opposite to the side 301, a side 303, and a side 304 opposite to the side 303.

The connector 83 is provided on the side 304 of the substrate 300. The connector 83 has a plurality of not-shown terminals arranged in parallel along the side 304. Further, the connectors 84 and 85 are provided on the side 302 of the substrate 300, the connector 84 is located on the side 303 side, and the connector 85 is located on the side 304 side. Then, each of the connectors 84 and 85 has a plurality of not-shown terminals arranged in parallel along the side 302.

Further, the driving signal generating circuits 310*a* and 310*b* and the reference voltage signal generating circuit 320 are provided on the substrate 300. In detail, the driving signal generating circuits 310*a* and 310*b* and the reference voltage generating circuit 320 are provided in an order of the driving signal generating circuit 310*a*, the driving signal generating circuit 310*b*, and the reference voltage signal generating circuit 320 in a direction from the side 303 toward the side 304.

The correction circuit 340 is located on the side 302 side of the driving signal generating circuits 310*a* and 310*b* and the reference voltage signal generating circuit 320. In detail, the resistor 341 is located on the side 302 side of the driving signal generating circuit 310*a*, and the coil 344 is located on the side 302 side of the resistor 341. Then, the driving signal generating circuit 310*a* and the connector 84 are electrically coupled to each other through the wire 361, the resistor 341, and the coil 344. Further, the resistor 342 is located on the side 302 side of the driving signal generating circuit 310*b*, and the coil 345 is located on the side 302 side of the resistor 342. Then, the driving signal generating circuit 310*b* and the connector 84 are electrically coupled to each other through the wire 362, the resistor 342, and the coil 345. Further, the connector 84 is located on the side 302 side of the reference voltage signal generating circuit 320. Then, the reference voltage signal generating circuit 320 and the connector 84 are electrically coupled to each other through the wire 363.

Here, the connector 84 electrically coupled to the wires 361, 362, and 363 is an example of an output connector.

At this time, the correction circuit 340 is located apart from the driving signal generating circuits 310*a* and 310*b* and the reference voltage signal generating circuit 320, and is located near the connector 84.

In detail, the shortest distance between the correction circuit 340 and the connector 84 is shorter than the shortest distance between the correction circuit 340 and the driving signal generating circuit 310*a*, is shorter than the shortest distance between the correction circuit 340 and the driving signal generating circuit 310*b*, and is shorter than the shortest distance between the correction circuit 340 and the reference voltage signal generating circuit 320. In other words, in the path through which the driving signal COM-A is propagated, the impedance of the wire 361 electrically connecting the driving signal generating circuit 310*a* and the correction circuit 340 to each other is larger than the impedance of a wire electrically connecting the correction circuit 340 and the connector 84 to each other. In the path through which the driving signal COM-B is propagated, the impedance of the wire 362 electrically connecting the driving signal generating circuit 310*b* and the correction circuit 340 to each other is larger than the impedance of the wire electrically connecting the correction circuit 340 and the connector 84 to each other.

As described above, the correction circuit 340 is located apart from the driving signal generating circuits 310*a* and 310*b* and the reference voltage signal generating circuit 320, so that it is possible to reduce influence of the heat generated by the correction circuit 340 on the driving signal generating circuits 310*a* and 310*b* and the reference voltage signal generating circuit 320. Therefore, a change in properties due to the heat of the driving signal generating circuits 310*a* and 310*b* and the reference voltage signal generating circuit 320 is reduced. Therefore, accuracy of the driving signals COM-A and COM-B and the reference voltage signal VBS generated by the driving signal generating circuits 310*a* and 310*b* and the reference voltage signal generating circuit 320 is improved.

Further, as shown in FIG. 20, when the shortest distance between the driving signal generating circuit 310*a* and the connector 84 is smaller than the shortest distance between the driving signal generating circuit 310*b* and the connector 84, the inductance value of the coil 344 is larger than the inductance value of the coil 345.

The driving signals COM-A and COM-B and the reference voltage signal VBS output from the driving circuit board 30 are commonly propagated to the liquid discharging head 40 through the cable 86. That is, changes in parasitic resistance components of the paths through which the driving signals COM-A and COM-B are propagated after the driving signals COM-A and COM-B are output from the driving circuit board 30 are small. Thus, the parasitic resistance components of the paths through which the driving signals COM-A and COM-B are propagated contribute to the lengths of the paths through which the driving signals COM-A and COM-B are propagated on the driving circuit board 30. Therefore, when the shortest distance between the driving signal generating circuit 310*a* and the connector 84 is smaller than the shortest distance between the driving signal generating circuit 310*b* and the connector 84, a parasitic inductance component of the path through which the driving signal COM-A is propagated is smaller than a parasitic inductance component of the path through which the driving signal COM-B is propagated. That is, there is a high possibility that the discharge speed v-jet of the ink discharged from the nozzle corresponding to the piezoelectric element 60 to which the driving signal VOUT is supplied based on the driving signal COM-A is smaller than the discharge speed v-jet of the ink discharged from the nozzle corresponding to the piezoelectric element 60 to which the driving signal VOUT is supplied based on the driving signal COM-B.

As the inductance value of the coil 344 is larger than the inductance value of the coil 345, it is possible to reduce a difference between the discharge speed v-jet of the ink discharged from the nozzle corresponding to the piezoelectric element 60 to which the driving signal VOUT is supplied based on the driving signal COM-A and the discharge speed v-jet of the ink discharged from the nozzle corresponding to the piezoelectric element 60 to which the driving signal VOUT is supplied based on the driving signal COM-B.

As described above, as the liquid ejecting apparatus 1 according to the present embodiment includes the correction circuit 340 including the coil 343, it is possible to reduce a possibility that the discharge speed v-jet of the ink is reduced. Therefore, as shown in FIGS. 1 to 4, as the plurality of driving circuit boards 30 and the liquid discharging head 40 are mounted on the carriage 71, it is possible to reduce a possibility that even when inductance components generated between the driving circuit boards 30 and the liquid discharging head 40 are reduced, the discharge speed v-jet of the ink is reduced.

8. Operation and Effect

In the above-described liquid ejecting apparatus 1, the driving signal VOUT based on the driving signals COM-A and COM-B is supplied to the one end of the piezoelectric element 60, and the reference voltage signal VBS is supplied to the other end of the piezoelectric element 60. That is, the current supplied to the piezoelectric element 60 flows through the propagation path 351 including the wire 361, the propagation path 352 including the wire 362, and the propagation path 353 including the wire 363. As such a propagation path 351 that is a path through which a current is supplied to the piezoelectric element 60 has the coil 344, and the propagation path 352 has the coil 345, it is possible to reduce a dominant resistance component in the current path. Therefore, it is possible to reduce a possibility that the discharge speed v-jet of the ink is reduced.

Further, as the coil 344 is included in the propagation path 351 through which the driving signal COM-A is propagated, and the coil 345 is included in the propagation path 352 through which the driving signal COM-B is propagated, it is possible to reduce a difference between the discharge speed v-jet of the ink discharged from the nozzle corresponding to the piezoelectric element 60 to which the driving signal VOUT is supplied based on the driving signal COM-A and the discharge speed v-jet of the ink discharged from the nozzle corresponding to the piezoelectric element 60 to which the driving signal VOUT is supplied based on the driving signal COM-B.

9. Modification Example

It has been described that the above-described liquid ejecting apparatus 1 is a serial ink jet printer in which the liquid discharging head 40 that discharges the ink is mounted on the carriage 71 and which performs printing as the carriage 71 reciprocates on the medium P. However, the liquid ejecting apparatus 1 may be a so-called line type ink jet printer in which the liquid discharging heads 40 are arranged side by side in the width direction of the medium P and which performs printing as the medium P is transported.

Although the embodiments and the modification examples have been described above, the present disclosure is not limited to these embodiments, and may be carried out in various modes without departing from the gist thereof. For example, the above-described embodiments can be combined appropriately.

The present disclosure includes a configuration that is substantially the same as the configuration described in the embodiments (for example, a configuration having the same function, method, and result or a configuration having the same purpose and effect). Further, the present disclosure includes configurations in which nonessential parts of the configurations described in the embodiments are replaced. Further, the present disclosure also includes configurations that have the same effects as those of the embodiments or configurations that can achieve the same objects as those of the embodiments. Further, the present disclosure includes a configuration obtained by adding a known technique to the configurations described in the embodiments.

What is claimed is:

1. A liquid ejecting apparatus comprising:

a liquid discharging head having a first nozzle and a first piezoelectric element;

a first driving signal generating circuit;

a substrate on which the first driving signal generating circuit is provided;

a first wire; and a first coil, wherein the first driving signal generating circuit generates a first driving signal, the first piezoelectric element is driven based on the first driving signal to discharge liquid from the first nozzle, the first wire is a part of a first path that is electrically coupled to the first driving signal generating circuit and propagates the first driving signal to the first piezoelectric element through the first coil, and the first path contains the first coil having a first inductance and the first wire having a second inductance, and the first inductance is different from the second inductance.

2. The liquid ejecting apparatus according to claim 1, further comprising:

a resistance element, wherein the first path propagates the first driving signal to the first piezoelectric element through the first coil and the resistance element.

3. The liquid ejecting apparatus according to claim 1, wherein the first coil is provided on the substrate, the first path contains one end which is electrically connected to the first drive signal generation circuit via the first coil and the other end which is electrically connected to the liquid discharge head.

4. The liquid ejecting apparatus according to claim 1, further comprising:

a second driving signal generating circuit that generates a second driving signal;

a second wire; and a second coil, wherein the liquid discharging head has a second nozzle and a second piezoelectric element, the second piezoelectric element is driven based on the second driving signal to discharge liquid from the second nozzle, the second wire is a part of a second path that is electrically coupled to the second driving signal generating circuit and propagates the second driving signal to the second piezoelectric element through the second coil, and the second path contains the second coil having a third inductance and the second wire having a fourth inductance, and the third inductance is different from the fourth inductance.

5. The liquid ejecting apparatus according to claim 4, wherein a waveform of the first driving signal is different from a waveform of the second driving signal, and the first inductance of the first coil is different from the third inductance of the second coil.

6. The liquid ejecting apparatus according to claim 4, further comprising:

an output connector to which the first wire and the second wire are electrically coupled, wherein the second driving signal generating circuit and the output connector are provided on the substrate, a shortest distance between the first driving signal generating circuit and the output connector is smaller than a shortest distance between the second driving signal generating circuit and the output connector, and the first inductance of the first coil is larger than the third inductance of the second coil.

7. The liquid ejecting apparatus according to claim 1, further comprising:

a head unit including the substrate on which the first driving signal generating circuit is provided and the liquid discharging head; and a discharge control circuit that generates a signal for controlling an operation of the head unit, wherein the head unit and the discharge control circuit are electrically coupled to each other through a cable.

8. A driving circuit for driving a capacitive load, comprising:

a first driving signal generating circuit;

a substrate on which the first driving signal generating circuit is provided;

a first wire; and a first coil, wherein the first driving signal generating circuit generates a first driving signal, the first wire is a part of a first path that is electrically coupled to the first driving signal generating circuit and propagates the first driving signal to the capacitive load through the first coil, and the first path contains the first coil having a first inductance and the first wire having a second inductance, and the first inductance is different from the second inductance.

* * * * *